US006143486A

United States Patent [19]

Parton et al.

[11] Patent Number: 6,143,486

[45] Date of Patent: Nov. 7, 2000

[54] PHOTOGRAPHIC MATERIAL HAVING ENHANCED LIGHT ABSORPTION

[75] Inventors: Richard L. Parton, Webster; Thomas L. Penner, Fairport; William J. Harrison, Rochester, all of N.Y.

[73] Assignee: Eastman Kodak Company, Rochester, N.Y.

[21] Appl. No.: 09/151,974

[22] Filed: Sep. 11, 1998

[51] Int. Cl.[7] ..... G03C 1/29; G03C 1/20

[52] U.S. Cl. ..... 430/574; 572/581; 572/583; 572/584; 572/585; 572/944

[58] Field of Search ..... 430/572, 57, 574, 430/578, 583, 582, 584, 586, 585, 587, 581, 588, 944, 591

[56] References Cited

U.S. PATENT DOCUMENTS

| | | |
|---|---|---|
| 2,518,731 | 8/1950 | Thompson . |
| 3,622,316 | 11/1971 | Bird et al. . |
| 3,976,493 | 8/1976 | Borror et al. . |
| 3,976,640 | 8/1976 | Borror et al. . |
| 4,040,825 | 8/1977 | Steiger et al. . |
| 4,138,551 | 2/1979 | Steiger et al. . |
| 4,820,606 | 4/1989 | Miyasaka et al. . |
| 4,950,587 | 8/1990 | Roberts et al. . |

FOREIGN PATENT DOCUMENTS

| | | |
|---|---|---|
| 270082 | 7/1992 | European Pat. Off. . |
| 565074 | 10/1993 | European Pat. Off. . |
| 270079 | 3/1994 | European Pat. Off. . |
| 838719 | 4/1998 | European Pat. Off. . |
| 64-91134 | 4/1989 | Japan . |
| 10171058 | 6/1998 | Japan . |

OTHER PUBLICATIONS

G. R. Bird, *Photogr. Sci. and Eng.*, vol. 18, No. 5, 1974, p. 52.

T. Forster, *Disc. Faraday Soc.*, vol. 27, 1959, p. 7.

R.Steiger and J. F. Reber, *Photogr. Sci. and Eng.*, vol. 27, 1983, p. 59.

T. L. Penner and P. B. Gilman, *Photogr. Sci. and Eng.*, vol. 20, 1976, p. 97.

T. L. Penner, *Photogr. Sci. and Eng.*, vol. 21, 1977, p. 32.

Hackh's Chemical Dictionary, Fourth Edition, Julius Grant, 1969.

*Primary Examiner*—Thorl Chea

*Attorney, Agent, or Firm*—Edith A. Rice

[57] ABSTRACT

This invention comprises a silver halide photographic material comprising at least one silver halide emulsion comprising silver halide grains having associated therewith at least two dye layers comprising (a) an inner dye layer adjacent to the silver halide grain and comprising at least one dye that is capable of spectrally sensitizing silver halide and (b) an outer dye layer adjacent to the inner dye layer and comprising at least one dye, wherein the dye layers are held together by non-covalent forces or by in situ bond formation; the outer dye layer adsorbs light at equal or higher energy than the inner dye layer; and the energy emission wavelength of the outer dye layer overlaps with the energy absorption wavelength of the inner dye layer.

This invention also comprises a silver halide photographic material comprising at least one silver halide emulsion comprising silver halide grains having associated therewith at least one dye having at least one anionic substituent and at least one dye having at least one cationic substituent.

36 Claims, 3 Drawing Sheets

PHOTOGRAPHIC MATERIAL HAVING ENHANCED LIGHT ABSORPTION

FIELD OF THE INVENTION

This invention relates to silver halide photographic material containing at least one silver halide emulsion which has enhanced light absorption.

BACKGROUND OF THE INVENTION

J-aggregating cyanine dyes are used in many photographic systems. It is believed that these dyes adsorb to a silver halide emulsion and pack together on their "edge" which allows the maximum number of dye molecules to be placed on the surface. However, a monolayer of dye, even one with as high an extinction coefficient as a J-aggregated cyanine dye, absorbs only a small fraction of the light impinging on it per unit area. The advent of tabular emulsions allowed more dye to be put on the grains due to increased surface area. However, in most photographic systems, it is still the case that not all the available light is being collected.

Increasing the absorption cross-section of the emulsion grains should lead to an increased photographic sensitivity. The need is especially great in the blue spectral region where a combination of low source intensity and relatively low dye extinction result in deficient photoresponse. The need for increased light absorption is also great in the green sensitization of the magenta layer of color negative photographic elements. The eye is most sensitive to the magenta image dye and this layer has the largest impact on color reproduction. Higher speed in this layer can be used to obtain improved color and image quality characteristics and reduce radiation sensitivity. The cyan layer can also benefit from improved spectral sensitivity and lower radiation sensitivity that can be obtained by enhanced red-light absorption. For certain applications it may be useful to enhance infrared light absorption in infrared sensitized photographic elements to achieve greater sensitivity and image quality characteristics.

One way to achieve greater light absorption is to increase the amount of spectral sensitizing dye associated with the individual grains beyond monolayer coverage of dye (some proposed approaches are described in the literature, G. R. Bird, *Photogr. Sci. Eng.,* 18, 562 (1974)). One method is to synthesize molecules in which two dye chromophores are covalently connected by a linking group (see U.S. Pat. No. 2,518,731, U.S. Pat. No. 3,976,493, U.S. Pat. No. 3,976,640, U.S. Pat. No. 3,622,316, Kokai Sho 64(1989)91134, and EP 565,074). This approach suffers from the fact that when the two dyes are connected they can interfere with each other's performance, e.g., not aggregating on or adsorbing to the silver halide grain properly.

In a similar approach, several dye polymers were synthesized in which cyanine dyes were tethered to poly-L-lysine (U.S. Pat. No. 4,950,587). These polymers could be combined with a silver halide emulsion, however, they tended to sensitize poorly and dye stain (an unwanted increase in D-min due to retained sensitizing dye after processing) was severe in this system and unacceptable.

A different strategy involves the use of two dyes that are not connected to one another. In this approach the dyes can be added sequentially and are less likely to interfere with one another. Miysaka et al. in EP 270 079 and EP 270 082 describe silver halide photographic material having an emulsion spectrally sensitized with an adsorable sensitizing dye used in combination with a non-adsorable luminescent dye which is located in the gelatin phase of the element. Steiger et al. in U.S. Pat. No. 4,040,825 and U.S. Pat. No. 4,138,551 describe silver halide photographic material having an emulsion spectrally sensitized with an adsorable sensitizing dye used in combination with second dye which is bonded to gelatin. The problem with these approaches is that unless the dye not adsorbed to the grain is in close proximity to the dye adsorbed on the grain (less than 50 angstroms separation) efficient energy transfer will not occur (see T. Förster, *Disc. Faraday Soc.,* 27 (1959)). Most dye off-the-grain in these systems will not be close enough to the silver halide grain for energy transfer, but will instead absorb light and act as a filter dye leading to a speed loss. A good analysis of the problem with this approach is given by Steiger et al. (*Photogr. Sci. Eng.,* 27, 59 (1983)).

A more useful method is to have two or more dyes form layers on the silver halide grain. Penner and Gilman described the occurrence of greater than monolayer levels of cyanine dye on emulsion grains, *Photogr. Sci Eng.,* 20, 97 (1976); see also Penner, *Photogr. Sci. Eng.,* 21, 32 (1977). In these cases, the outer dye layer absorbed light at a longer wavelength than the inner dye layer (the layer adsorbed to the silver halide grain). Bird et al. in U.S. Pat. No. 3,622,316 describe a similar system. A requirement was that the outer dye layer absorb light at a shorter wavelength than the inner layer. The problem with prior art dye layering approaches was that the dye layers described produced a very broad sensitization envelope. This would lead to poor color reproduction since, for example, the silver halide grains in the same color record would be sensitive to both green and red light.

Yamashita et. al. (EP 838 719 A2) describes the use of two or more cyanine dyes to form dye layers on silver halide emulsions. The preferred dyes are required to have at least one aromatic or heteroaromatic substitutent attached to the chromophore via the nitrogen atoms of the dye. This is undesirable because such substitutents can lead to large amounts of retained dye after processing (dye stain) which affords increased D-min. We have found that this is not necessary and that neither dye is required to have a at least one aromatic or heteroaromatic substitute attached to the chromophore via the nitrogen atoms of the dye. The dyes of our invention give increased photographic sensitivity.

PROBLEM TO BE SOLVED BY THE INVENTION

Not all the available light is being collected in many photographic systems. The need is especially great in the blue spectral region where a combination of low source intensity and relatively low dye extinction result in deficient photoresponse. The need for increased light absorption is also great in the green sensitization of the magenta layer of color negative photographic elements. The eye is most sensitive to the magenta image dye and this layer has the largest impact on color reproduction. Higher speed in this layer can be used to obtain improved color and image quality characteristics. The cyan layer could also benefit from increased red-light absorption which could allow the use of smaller emulsions with less radiation sensitivity and improved color and image quality characteristics. For certain applications, it may be useful to enhance infrared light absorption in infrared sensitized photographic elements to achieve greater sensitivity and image quality characteristics.

SUMMARY OF THE INVENTION

We have found that it is possible to form more than one dye layer on silver halide emulsion grains and that this can afford increased light absorption. The dye layers are held together by a non-covalent attractive force such as electrostatic bonding, van der Waals interactions, hydrogen bonding, hydrophobic interactions, dipole-dipole interactions, dipole-induced dipole interactions, London dispersion forces, cation—π interactions, etc. or by in situ bond formation. The inner dye layer(s) is absorbed to the silver halide grains and contains at least one spectral sensitizer. The outer dye layer(s) (also referred to herein as an antenna dye layer(s)) absorbs light at an equal or higher energy (equal or shorter wavelength) than the adjacent inner dye layer(s). The light energy emission wavelength of the outer dye layer overlaps with the light energy absorption wavelength of the adjacent inner dye layer.

We have also found that silver halide grains sensitized with at least one dye containing at least one anionic substituent and at least one dye containing at least one cationic substituent provides increased light absorption.

One aspect of the invention comprises a silver halide photographic material comprising at least one silver halide emulsion comprising silver halide grains having associated therewith at least two dye layers comprising (a) an inner dye layer adjacent to the silver halide grain and comprising at least one dye that is capable of spectrally sensitizing silver halide and (b) an outer dye layer adjacent to the inner dye layer and comprising at least one dye, wherein the dye layers are held together by non-covalent forces or by in situ bond formation; the outer dye layer adsorbs light at equal or higher energy than the inner dye layer; and the energy emission wavelength of the outer dye layer overlaps with the energy absorption wavelength of the inner dye layer.

Another aspect of this invention comprises a silver halide photographic material comprising at least one silver halide emulsion comprising silver halide grains having associated therewith at least one dye having at least one anionic substituent and at least one dye having at least one cationic substituent. In preferred embodiments of the invention, the cationic dye contains at least two cationic substituents.

ADVANTAGEOUS EFFECT OF THE INVENTION

The invention increases light absorption and photographic sensitivity. The increased sensitivity can also provide improved granularity by enabling the use of smaller grain size emulsions. The relatively slow speed of the small grain emulsions is compensated for by the increased light absorption of the dye layers of the invention. In addition to improved granularity, the smaller emulsions would have lower ionizing radiation sensitivity which is determined by the mass of silver halide per grain. Further the invention can provide good color reproduction, i.e., no excessive unwanted photographic sensitivity in more than one color record.

BRIEF DESCRIPTION OF THE DRAWINGS

Each of FIGS. 1–3 show the spectra when a first dye is used alone and when said dye is used in combination with a second dye, as discussed in more detail below.

DETAILED DESCRIPTION OF THE INVENTION

Figure 1:
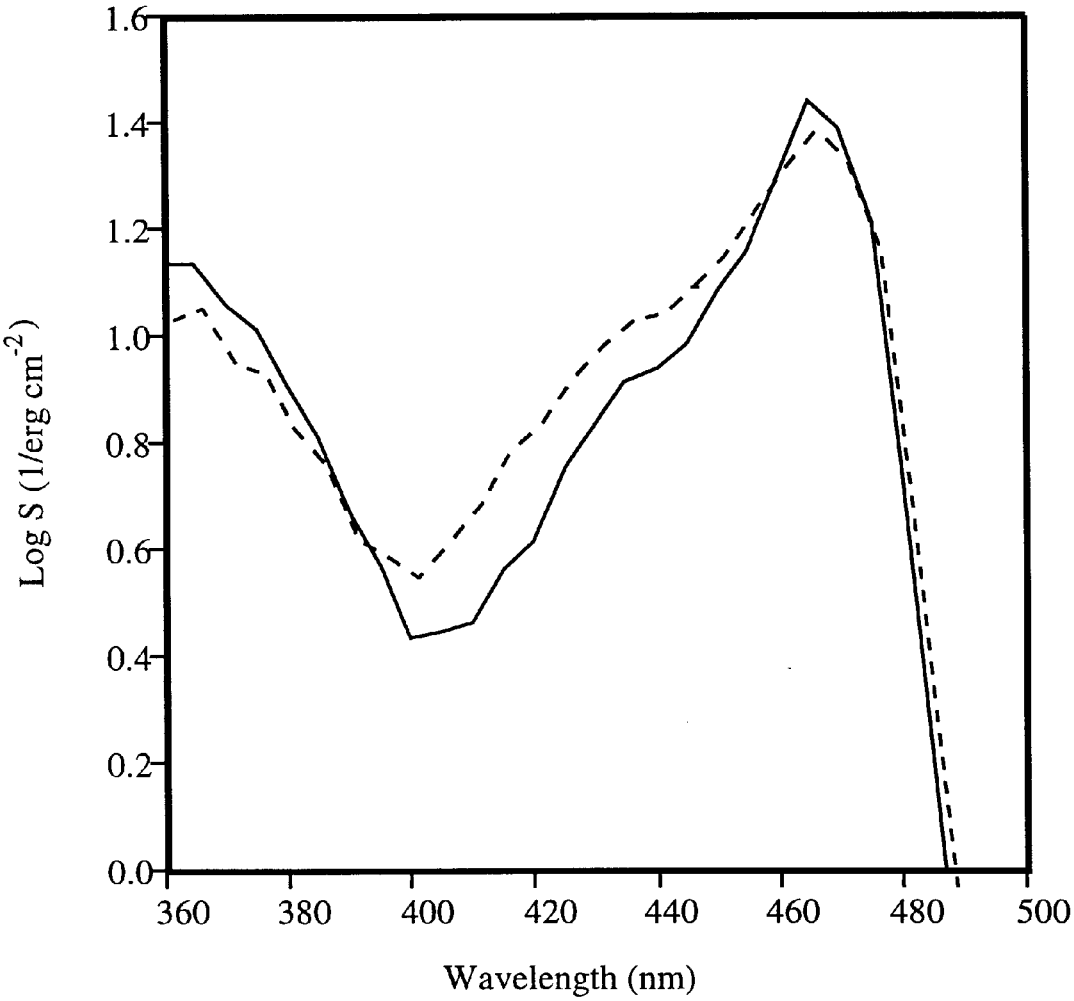

As mentioned above, in preferred embodiments of the invention silver halide grains have associated therewith dyes layers that are held together by non-covalent attractive forces. Examples of non-covalent attractive forces include electrostatic attraction, hydrophobic interactions, hydrogen-bonding, van der Waals interactions, dipole-dipole interactions, dipole-induced dipole interactions, London dispersion forces, cation—π interactions or any combinations of these. In addition, in situ bond formation between complementary chemical groups is valuable for this invention. For example, one layer of dye containing at least one boronic acid substituent can be formed. Addition of a second dye having at least one diol substituent results in the formation of two dye layers by the in situ formation of boron-diol bonds between the dyes of the two layers. Another example of in situ bond formation is the formation of a metal complex between dyes that are adsorbed to silver halide and dyes that can form a second or subsequent layer. For example, zirconium could be useful for binding dyes with phosphonate substitutents into dye layers. For a non-silver halide example see H. E. Katz et. al., Science, 254, 1485, (1991). Also see A. Shanzer et. al., Chem. Eur. J. 4, 502, (1998).

In one preferred embodiment of the invention the silver halide emulsion is dyed with a saturation or near saturation monolayer of one or more cyanine dyes which have either a positive or negative net charge or the net charge can be zero if one of the substitutents has a negative charge. The area a dye covers on the silver halide surface can be determined by preparing a dye concentration series and choosing the dye level for optimum performance or by well-known techniques such as dye adsorption isotherms (for example see W. West, B. H. Carroll, and D. H. Whitcomb, J. Phys. Chem, 56, 1054 (1962)). The second layer consists of dyes which have a net charge of opposite sign compared to the dyes of the first layer.

In another preferred embodiment, the dye or dyes of the outer dye layer and the dye or dyes of the inner dye layer have their maximum light absorption either between 400 to 500 nm or between 500 to 600 nm or between 600 and 700 nm or between 700 and 1100 nm.

In another preferred embodiment the silver halide emulsion is dyed with a saturation monolayer of negatively charged cyanine dye. The second layer consists of dyes with positive charges. In another preferred embodiment the second layer consists of cyanine dyes with at least one substituent that has a positive charge. Speed increases of greater than 0.15 log E (40% increase) for daylight type exposures were observed.

To determine the increased light absorption by the photographic element as a result of forming an outer dye layer in addition to the inner dye layer, it is necessary to compare the overall absorption of the emulsion subsequent to the addition of the dye or dyes of the inner dye layer with the overall absorption of the emulsion subsequent to the further addition of the dye or dyes of the outer dye layer. This measurement of absorption can be done in a variety of ways known in the art, but a particularly convenient and directly applicable method is to measure the absorption spectrum as a function of wavelength of a coating prepared on a planar support from the liquid emulsion in the same manner as is conventionally done for photographic exposure evaluation. The methods of measurement of the total absorption spectrum, in which the absorbed fraction of light incident in a defined manner on a sample as a function of the wavelength of the impinging light for a turbid material such as a photographic emulsion coated onto a planar support, have been described in detail (for example see F. Grum and R. J. Becherer, "Optical Radiation Measurements, Vol. 1, Radiometry", Academic Press, New York, 1979). The absorbed fraction of incident light can be designated by A(λ), where A is the fraction of incident light absorbed and λ is the corresponding wavelength of light. Although A(λ) is itself a useful parameter allowing graphical demonstration of the increase in light absorption resulting from the formation of additional dye layers described in this invention, it is desirable to replace such a graphical comparison with a numerical one. Further, the effectiveness with which the light absorption capability of an emulsion coated on a planar support is converted to photographic image depends, in addition to A(λ), on the wavelength distribution of the irradiance I(λ) of the exposing light source. (Irradiance at different wavelengths of light sources can be obtained by well-known measurement techniques. See, for example, F. Grum and R. J. Becherer, "Optical Radiation Measurements, Vol. 1, Radiometry", Academic Press, New York, 1979.) A further refinement follows from the fact that photographic image formation is, like other photochemical processes, a quantum effect so that the irradiance, which is usually measured in units of energy per unit time per unit area, needs to be converted into quanta of light N(λ) via the formula $N(\lambda)=I(\lambda)\lambda/hc$ where h is Planck's constant and c is the speed of light. Then the number of absorbed photons per unit time per unit area at a given wavelength for a photographic coating is given by: $N_a(\lambda)=A(\lambda)N(\lambda)$. In most instances, including the experiments described in the Examples of this invention, photographic exposures are not performed at a single or narrow range of wavelengths but rather simultaneously over a broad spectrum of wavelengths designed to simulate a particular illuminant found in real photographic situations, for example daylight. Therefore the total number of photons of light absorbed per unit time per unit area from such an illuminant consists of a summation or integration of all the values of the individual wavelengths, that is: $N_a\int A(\lambda)N(\lambda)d\lambda$, where the limits of integration correspond to the wavelength limits of the specified illuminant. In the Examples of this invention, comparison is made on a relative basis between the values of the total number of photons of light absorbed per unit time per unit area of the coating of emulsion containing the sensitizing inner dye layer alone set to a value of 100 and the total number of photons of light absorbed per unit time of the coatings containing an outer dye layer in addition to inner dye layer. These relative values of $N_a$ are designated as Normalized Relative Absorption and are tabulated in the Examples. Enhancement of the Normalized Relative Absorption is a quantitative measure of the advantageous light absorption effect of this invention.

As stated in the Background of the Invention, some previous attempts to increase light absorption of emulsions resulted in the presence of dye that was too remote from the emulsion grains to effect energy transfer to the dye adsorbed to the grains, so that a significant increase in photographic sensitivity was not realized. Thus an enhancement in Relative Absorption by an emulsion is alone not a sufficient measurement of the effectiveness of additional dye layers. For this purpose a metric must be defined that relates the enhanced absorption to the resulting increase in photographic sensitivity. Such a parameter is now described.

Photographic sensitivity can be measured in various ways. One method commonly practiced in the art and described in numerous references (for example in *The Theory of the Photographic Process,* $4^{th}$ edition, T. H. James, editor, Macmillan Publishing Co., New York, 1977) is to expose an emulsion coated onto a planar substrate for a specified length of time through a filtering element, or tablet interposed between the coated emulsion and light source which modulates the light intensity in a series of uniform steps of constant factors by means of the constructed increasing opacity of the filter elements of the tablet. As a result the exposure of the emulsion coating is spatially reduced by this factor in discontinuous steps in one direction, remaining constant in the orthogonal direction. After exposure for a time required to cause the formation of developable image through a portion but not all the exposure steps, the emulsion coating is processed in an appropriate developer, either black and white or color, and the densities of the image steps are measured with a densitometer. A graph of exposure on a relative or absolute scale, usually in logarithmic form, defined as the irradiance multiplied by the exposure time, plotted against the measured image density can then be constructed. Depending on the purpose, a suitable image density is chosen as reference (for example 0.15 density above that formed in a step which received too low an exposure to form detectable exposure-related image). The exposure required to achieve that reference density can then be determined from the constructed graph, or its electronic counterpart. The inverse of the exposure to reach the reference density is designated as the emulsion coating sensitivity S. The value of $Log_{10}S$ is termed the speed. The exposure can be either monochromatic over a small wavelength range or consist of many wavelengths over a broad spectrum as already described. The film sensitivity of emulsion coatings containing only the inner dye layer or, alternatively, the inner dye layer plus an outer dye layer can be measured as described using a specified light source, for example a simulation of daylight. The photographic sensitivity of a particular example of an emulsion coating containing the inner dye layer plus an outer dye layer can be compared on a relative basis with a corresponding reference of an emulsion coating containing only the inner dye layer by setting S for the latter equal to 100 and multiplying this times the ratio of S for the invention example coating containing an inner dye layer plus outer dye layer to S for the s comparison example containing only the inner dye layer. These values are designated as Normalized Relative Sensitivity. They are tabulated in the Examples along with the corresponding speed values. Enhancement of the Normalized Relative Sensitivity is a quantitative measure of the advantageous photographic sensitivity effect of this invention.

As a result of these measurements of emulsion coating absorption and photographic sensitivity, one obtains two sets of parameters for each example, $N_a$ and S, each relative to 100 for the comparison example containing only the inner dye layer. The exposure source used to calculate $N_a$ should be the same as that used to obtain S. The increase in these parameters $N_a$ and S over the value of 100 then represent respectively the increase in absorbed photons and in photographic sensitivity resulting from the addition of an outer dye layer of this invention. These increases are labeled respectively $\Delta N_a$ and $\Delta S$. It is the ratio of $\Delta S/\Delta N_a$ that measures the effectiveness of the outer dye layer to increase photographic sensitivity. This ratio, multiplied by 100 to convert to a percentage, is designated the Layering Efficiency, designated E, and is tabulated in the Examples, set forth below along with S and $N_a$. The Layering Efficiency measures the effectiveness of the increased absorption of this invention to increase photographic sensitivity. When either ΔS or ΔNa is zero, then the Layering Efficiency is effectively zero.

In preferred embodiments, the following relationship is met:

$$E=100\Delta S/\Delta N_a \geqq 10$$

and $$\Delta N_a \geq 10$$

wherein

E is the layering efficiency;

ΔS is the difference between the Normalized Relative Sensitivity (S) of an emulsion sensitized with the inner dye layer and the Normalized Relative Absorption of an emulsion sensitized with both the inner dye layer and the outer dye layer; and $\Delta N_a$ is the difference between the Normalized Relative Absorption ($N_a$) of an emulsion sensitized with the inner dye layer and the Normalized Relative Absorption of an emulsion sensitized with both the inner dye layer and the outer dye layer.

In another preferred embodiment, the dye or dyes of the outer layer forms a well-ordered liquid-crystalline phase (a lyotropic mesophase) in a solvent, typically an aqueous medium(for example, water, aqueous gelatin, methanolic aqueous gelatin, etc.), and preferably forms a smectic liquid-crystalline phase (W. J. Harrison, D. L. Mateer & G. J. T. Tiddy, *J.Phys.Chem.* 1996, 100, pp 2310–2321). More specifically, in one embodiment preferred outer layer dyes will form liquid-crystalline J-aggregates in aqueous-based media (in the absence of silver halide grains) at any equivalent molar concentration equal to, or up to 4 orders of magnitude greater than, but more preferably at any equivalent molar concentration equal to or less than, the optimum level of the inner layer dye deployed for conventional sensitization (see *The Theory of the Photographic Process,* $4^{th}$ edition, T. H. James, editor, Macmillan Publishing Co., New York, 1977, for a discussion of aggregation).

Mesophase-forming dyes may be readily identified by someone skilled in the art using polarized-light optical microscopy as described by N. H. Hartshorne in *The Microscopy of Liquid Crystals*, Microscope Publications Ltd., London, 1974. In one embodiment, preferred outer layer dyes when dispersed in the aqueous medium of choice (including water, aqueous gelatin, aqueous methanol, etc. with or without dissolved electrolyes, buffers, surfactants and other common sensitization addenda) at optimum concentration and temperature and viewed in polarized light as thin films sandwiched between a glass microscope slide and cover slip display the birefringent textures, patterns and flow rheology characteristic of distinct and readily identifiable structural types of mesophase (e.g. smectic, nematic, hexagonal). Furthermore, in one embodiment, the preferred dyes when dispersed in the aqueous medium as a liquid-crystalline phase generally exhibit J-aggregation resulting in a unique bathochromically shifted spectral absorption band yielding high fluorescence intensity. In another embodiment useful hypsochromically shifted spectral absorption bands may also result from the stabilization of a liquid-crystalline phase of certain other preferred dyes. In certain other embodiments of dye layering, especially in the case of dye layering via in situ bond formation, it may be desirable to use outer layer dyes that do not aggregate. In particularly preferred embodiments of the invention, the dye or dyes of the outer dye layer form a liquid-crystalline phase in aqueous gelatin at a concentration of 1 weight percent or less.

In one preferred embodiment, a molecule containing a group that strongly bonds to silver halide, such as a mercapto group (or a molecule that forms a mercapto group under alkaline or acidic conditions) or a thiocarbonyl group is added after the first dye layer has been formed and before the second dye layer is formed. Mercapto compounds represented by the following formula (A) are particularly preferred.

A

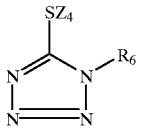

wherein $R_6$ represents an alkyl group, an alkenyl group or an aryl group and $Z_4$ represents a hydrogen atom, an alkali metal atom, an ammonium group or a protecting group that can be removed under alkaline or acidic conditions.

Examples of some preferred mercapto compounds are shown below.

A-1

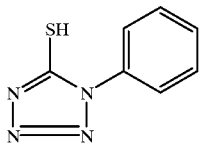

A-2

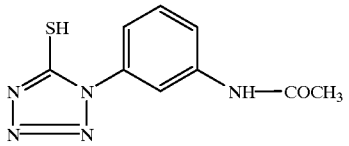

A-3

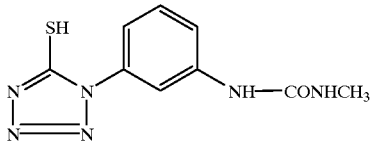

A-4

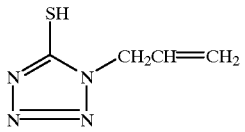

A-5

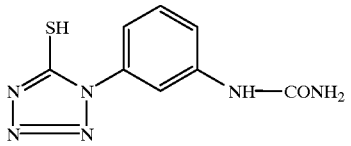

In describing preferred embodiments of the invention, one dye layer is described as an inner layer and one dye layer is described as an outer layer. It is to be understood that one or more intermediate dye layers may be present between the inner and outer dye layers, in which all of the layers are held together by non-covalent forces, as discussed in more detail above. Further, the dye layers need not completely encompass the silver halide grains of underlying dye layer(s). Also some mixing of the dyes between layers is possible.

The dyes of the inner dye layer are preferably any dyes capable of spectral sensitization, for example, a cyanine dye, merocyanine dye, complex cyanine dye, complex merocyanine dye, homopolar cyanine dye, or hemicyanine dye, etc. Of these dyes, merocyanine dyes containing a thiocarbonyl group and cyanine dyes are particularly useful. Of these cyanine dyes are especially useful. Particularly preferred is a cyanine dye of Formula Ia or a merocyanine dye of Formula Ib.

(Ia)

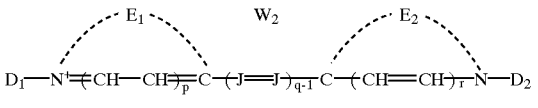

wherein:

$E_1$ and $E_2$ may be the same or different and represent the atoms necessary to form a substituted or unsubstituted heterocyclic ring which is a basic nucleus (see *The Theory of the Photographic Process,* $4^{th}$ edition, T. H. James, editor, Macmillan Publishing Co., New York, 1977, for a definition of basic and acidic nucleus), each J independently represents a substituted or unsubstituted methine group, q is a positive integer of from 1 to 4, p and r each independently represents 0 or 1, $D_1$ and $D_2$ each independently represents substituted or unsubstituted alkyl or substituted or unsubstituted aryl and at least one of $D_1$ and $D_2$ contains an anionic substituent; and $W_2$ is one or more a counterions as necessary to balance the charge;

(Ib)

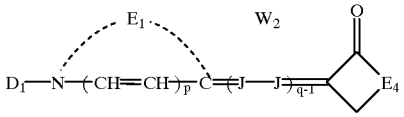

wherein $E_1$, $D_1$, J, p, q and $W_2$ are as defined above for Formula (Ia) wherein $E_4$ represents the atoms necessary to complete a substituted or unsubstituted heterocyclic acidic nucleus which preferably contains a thiocarbonyl group.

The dyes of the outer dye layer are not necessarily spectral sensitizers. Examples of preferred outer layer dyes are a cyanine dye, merocyanine dye, arylidene dye, complex cyanine dye, complex merocyanine dye, homopolar cyanine dye, hemicyanine dye, styryl dye, hemioxonol dye, oxonol, dye anthraquinone dye, triphenylmethane dye, azo dye type, azomethines, coumarin dye or others. Particularly preferred are dyes having structure IIa, IIb, and IIc, (IIa)

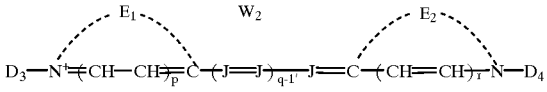

wherein:

$E_1$, $E_2$, J, p, q and $W_2$ are as defined above for Formula (Ia), $D_3$ and $D_4$ each independently represents substituted or unsubstituted alkyl or substituted or unsubstituted aryl and at least one of $E_1$, $E_2$, J or $D_3$ and $D_4$ contains a cationic substituent;

(IIb)

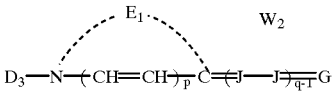

wherein $E_1$, $D_3$, J, p, q and $W_2$ are as defined above for Formula (I) and G represents

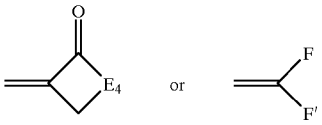

wherein $E_4$ represents the atoms necessary to complete a substituted or unsubstituted heterocyclic acidic nucleus which preferably does not contain a thiocarbonyl, and F and F' each independently represents a cyano radical, an ester radical, an acyl radical, a carbamoyl radical or an alkylsulfonyl radical, and at least one of E1, G, J or $D_3$ contains a cationic substituent, (IIc)

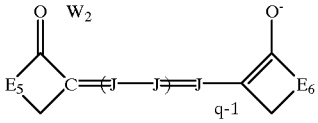

wherein J and $W_2$ are as defined above for Formula (I) above and q is 2,3 or 4, and $E_5$ and $E_6$ independently represent the atoms necessary to complete a substituted or unsubstituted acidic heterocyclic nucleus and at least one of J, $E_5$, or $E_6$; contains a cationic substituent.

In embodiments of the invention in which the inner dye is of Formula (Ia) and the outer dye is of Formula (IIa), if either $D_1$ or $D_2$ contains an aromatic or heteroaromatic group then $D_3$ and $D_4$ do not contain an aromatic or heteroaromatic group.

Particularly preferred is a photographic material in which the inner dye layer comprises a cyanine dye of Formula (Ic) and the outer dye layer comprises a dye of Formula (IId):

Ic

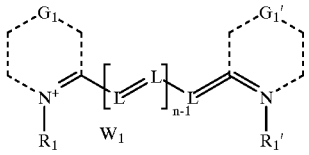

IId

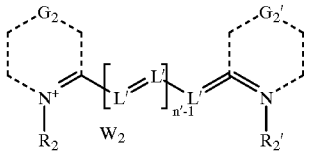

wherein:

$G_1$ and $G_1'$ independently represent the atoms necessary to complete a benzothiazole nucleus, benzoxazole nucleus, benzoselenazole nucleus, benzotellurazole nucleus, quinoline nucleus, or benzimidazole nucleus in which $G_1$ and $G_1'$ independently may be substituted or unsubstituted;

$G_2$ and $G_2'$ independently represent the atoms necessary to complete a benzothiazole nucleus, benzoxazole nucleus, benzoselenazole nucleus, benzotellurazole nucleus, quinoline nucleus, indole nucleus, or benzimidazole nucleus in which $G_2$, and $G_2'$ independently may be substituted or unsubstituted;

n and n' are independently a positive integer from 1 to 4, each L and L' independently represent a substituted or unsubstituted methine group, $R_1$ and $R_1'$ each independently represents substituted or unsubstituted aryl or substituted or unsubstituted aliphatic group, at least one of $R_1$ and $R_1'$ has a negative charge, $W_1$ is a cationic counterion to balance the charge if necessary, $R_2$ and $R_2'$ each independently represents substituted or unsubstituted aryl or substituted or unsubstituted aliphatic group and preferably at least one of $R_2$ and $R_2'$ has a positive charge; such that the net charge of II is +1, +2, +3, +4, or +5, $W_2$ is one or more anionic counterions to balance the charge.

In a preferred embodiment the silver halide emulsion is dyed with a saturation or near saturation monolayer of one or more dyes wherein at least one dye is a cyanine dye with an anionic substituent. The second layer consists of one or more dyes wherein at least one dye has a substituent that contains a positive charge. In another preferred embodiment the second layer comprises at least one cyanine dye with at least one substituent that contains a positive charge. In one preferred embodiment the substituent that contains positive charges is connected to the cyanine dye via the nitrogen atoms of the cyanine dye chromophore. However, preferably the anionic and cationic dyes of the invention do not both have an aromatic or heteroaromatic group attached to the dye by means of the nitrogen atoms of the cyanine chromophore.

Examples of positively charged substituents are 3-(trimethylammonio)propyl), 3-(4-ammoniobutyl), 3-(4-guanidinobutyl) etc. Other examples are any substitutents that take on a positive charge in the silver halide emulsion melt, for example, by protonation such as aminoalkyl substitutents, e.g. 3-(3-aminopropyl), 3-(3-dimethylaminopropyl), 4-(4-methylaminopropyl), etc. Examples of negatively charged substituents are 3-sulfopropyl, 2-carboxyethyl, 4-sulfobutyl, etc.

When reference in this application is made to a particular moiety as a "group", this means that the moiety may itself be unsubstituted or substituted with one or more substituents (up to the maximum possible number). For example, "alkyl group" refers to a substituted or unsubstituted alkyl, while "benzene group" refers to a substituted or unsubstituted benzene (with up to six substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched or unbranched and include ring structures.

Particularly preferred dyes for use in accordance with this invention are give in Tables I and IA.

TABLE I

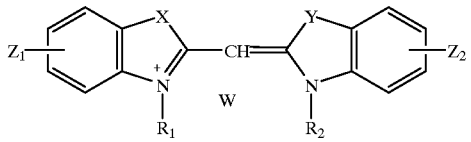

| Dye | $Z_1$ | $Z_2$ | X,Y | $R_1$ | $R_2$ | W | Net Charge |
|---|---|---|---|---|---|---|---|
| I-1 | 5-Ph | 5-Cl | S,S | $—(CH_2)_3SO_3^-$ | $—(CH_2)_3SO_3^-$ | $TEAH^+$ | −1 |
| I-2 | 5-Cl | 5-Cl | S,S | $—(CH_2)_3SO_3^-$ | $—(CH_2)_3SO_3^-$ | $Na^+$ | −1 |
| I-3 | 5-Ph | 5-Ph | S,S | $—(CH_2)_3SO_3^-$ | $—(CH_2)_3SO_3^-$ | $TEAH^+$ | −1 |
| I-4 | 5-Py | 5-Cl | S,S | $—(CH_2)_3SO_3^-$ | $—(CH_2)_3SO_3^-$ | $TEAH^+$ | −1 |
| I-5 | 5-Py | 5-Py | S,S | $—(CH_2)_3SO_3^-$ | $—(CH_2)_3SO_3^-$ | $TEAH^+$ | −1 |
| I-6 | 6-Me | 5-Ph | CH═CH,S | $—(CH_2)_3SO_3^-$ | $—(CH_2)_3SO_3^-$ | $TEAH^+$ | −1 |
| I-7 | 5-Ph | 5-Cl | S,S | $—(CH_2)_3OPO_3^{-2}$ | $—C_2H_5$ | $Na^+$ | −1 |
| II-1 | 5-Ph | 5-Cl | S,S | $—C_2H_5$ | $—C_2H_5$ | $Br^-$ | +1 |
| II-2 | 5-Cl | 5-Cl | S,S | $—(CH_2)_3N(Me)_3^+$ | $—(CH_2)_3SO_3^-$ | $Br^-$ | +1 |
| II-3 | 5-Cl | 5-Cl | S,S | $—(CH_2)_4—NH—C(=NH_2^+)NH_2$ | $—(CH_2)_3SO_3^-$ | $Br^-$ | +1 |
| II-4 | 5-Ph | 5-Cl | S,S | $—(CH_2)_3N(Me)_3^+$ | $—(CH_2)_3SO_3^-$ | $Br^-$ | +1 |

TABLE I-continued

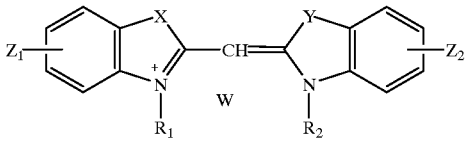

| Dye | $Z_1$ | $Z_2$ | X,Y | $R_1$ | $R_2$ | W | Net Charge |
|---|---|---|---|---|---|---|---|
| II-5 | 5-Ph | 5-Cl | O,S | $—(CH_2)_3SO_3^-$ | $—(CH_2)_3N(Me)_3^+$ | $Br^-$ | +1 |
| II-6 | 5-Cl | 5-Cl | S,S | $—(CH_2)_3N(Me)_3^+$ | $—(CH_2)_2CO_2^-$ | $Br^-$ | +1 |
| II-7 | 5-Py | 5-Py | S,S | $—(CH_2)_3N(Me)_3^+$ | $—(CH_2)_3SO_3^-$ | $Br^-$ | +1 |
| II-8 | 5-Ph | 5-Cl | S,S | $—(CH_2)_3N(Me)_3^+$ | $—C_2H_5$ | $2Br^-$ | +2 |
| II-9 | 5-Ph | 5-Cl | S,S | 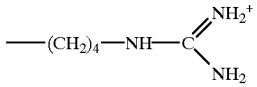 | $—CH_3$ | $2Br^-$ | +2 |
| II-10 | 5-Cl | 5-Cl | S,S | $—(CH_2)_3N(Me)_3^+$ | $—C_2H_5$ | $2Br^-$ | +2 |
| II-11 | 5-Ph | 5-Ph | S,S | $—(CH_2)_3N(Me)_3^+$ | $—C_2H_5$ | $2Br^-$ | +2 |
| II-12 | 5-Ph | 5-Cl | O,S | $—C_2H_5$ | $—(CH_2)_3N(Me)_3^+$ | $2Br^-$ | +2 |
| II-13 | 5-Cl | 5-Cl | S,S | $—(CH_2)_3N(Me)_3^+$ | $—(CH_2)_3N(Me)_3^+$ | $3Br^-$ | +3 |
| II-14 | 5-Ph | 5-Ph | S,S | $—(CH_2)_3N(Me)_3^+$ | $—(CH_2)_3N(Me)_3^+$ | $3Br^-$ | +3 |
| II-15 | 5-Ph | 5-Ph | S,S | 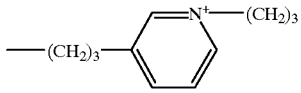 | Me | $3Br^-$ | +3 |
| II-16 | 5-Ph | 5-Ph | S,S | 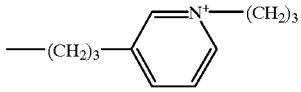 | 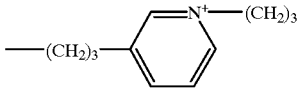 | $5Br^-$ | +5 |
| II-17 | 5-Ph | 5-Cl | S,S | $—(CH_2)_3P(Me)_3^+$ | $—C_2H_5$ | $2PTS^-$ | +2 |
| II-18 | 5,6-Me | 5-Ph | S,S | $—(CH_2)_3N(Me)_3^+$ | $—(CH_2)_3N(Me)_3^+$ | $3Br^-$ | +3 |
| II-19 | 6-Me | 5-Ph | CH═CH,S | $—(CH_2)_3N(Me)_3^+$ | $—(CH_2)_3N(Me)_3^+$ | $3Br^-$ | +3 |
| II-20 | 5-Ph | 5-Cl | S,S | $—(CH_2)_3NH_2$ | $—(CH_2)_3NH_2$ | $Br^-$ | +1 (+3)* |
| II-21 | 5-Ph | 5-Cl | S,S | $—(CH_2)_3NH_2$ | $(CH_2)_3SO_3^-$ | — | 0 (+1)* |
| II-22 | 5-Ph | 5-Cl | S,S | $—(CH_2)_3NH_2$ | $—C_2H_5$ | $Br^-$ | +1 (+2)* |

Me is methyl, Ph is phenyl, Py is pyrrole-1-yl, $TEAH^+$ is Triethylammonium, PTS is p-toluenesulfonate.
*Charge when protonated.

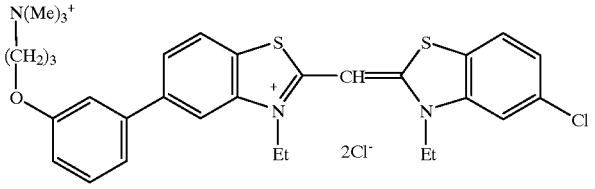

II-23

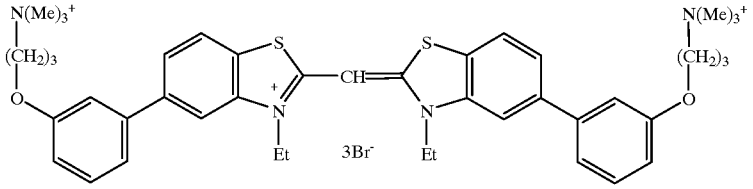

II-24

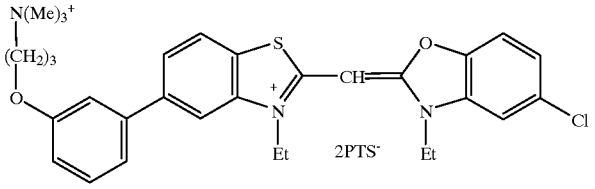

II-25

TABLE I-continued
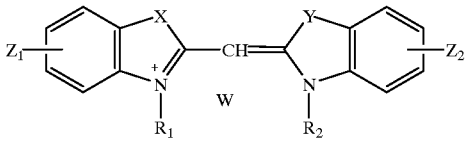
| Dye | $Z_1$ | $Z_2$ | X,Y | $R_1$ | $R_2$ | W | Net Charge |
|---|---|---|---|---|---|---|---|
| II-26 | | | | | | | |
| I-8 | | | | | | | |
| II-27 | | | | | | | |

TABLE IA

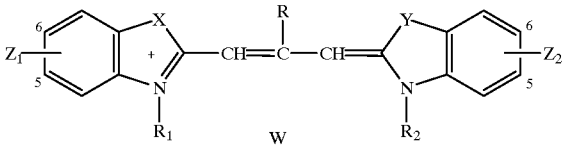

| Dye | X,Y | $R_1$ | $R_2$ | R | $Z_1$ | $Z_2$ | W | Net Charge |
|---|---|---|---|---|---|---|---|---|
| I-9 | O,O | $—(CH_2)_2CH(CH_3)SO_3^-$ | $—(CH_2)_2CH(CH_3)SO_3^-$ | Et | 5-Ph | 5-Ph | $TEAH^+$ | −1 |
| I-10 | O,O | $—(CH_2)_2CH(CH_3)SO_3^-$ | $—(CH_2)_3SO_3^-$ | Et | 5-Ph | 5-Cl | $TEAH^+$ | −1 |
| I-11 | S,O | $—(CH_2)_3SO_3^-$ | $—(CH_2)_3SO_3^-$ | Et | 5-Ph | 5-Cl | $TEAH^+$ | −1 |
| I-12 | S,S | $—(CH_2)_3SO_3^-$ | $—(CH_2)_3SO_3^-$ | Et | Cl | Cl | $Na^+$ | −1 |
| I-13 | S,S | $—(CH_2)_3SO_3^-$ | $—(CH_2)_3SO_3—$ | Et | Ph | Ph | $Na^+$ | −1 |
| I-14 | S,S | $—(CH_2)_3OPO_3^{-2}$ | $—C_2H_5$ | Et | Cl | Cl | $Na^+$ | −1 |
| I-15 | S,S | $—(CH_2)_3SO_3^-$ | $—(CH_2)_3SO_3^-$ | Et | 4,5Benzo | 4,5Benzo | $TEAH^+$ | −1 |
| II-28 | O,O | $—(CH_2)_3N(Me)_3^+$ | $—(CH_2)_3SO_3^-$ | Et | 5-Ph | 5-Cl | $Br^-$ | |
| II-29 | O,O | $—(CH_2)_3N(Me)_3^+$ | Et | Et | 5-Ph | 5-Cl | $2Br^-$ | +2 |
| II-30 | O,O | $—(CH_2)_3N(Me)_3^+$ | Et | Et | 5-Ph | 5-Ph | $2Br^-$ | +2 |
| II-31 | O,O | $—(CH_2)_3N(Me)_3^+$ | $—(CH_2)_3N(Me)_3^+$ | Et | 5-Ph | 5-Ph | $3Br^-$ | |
| II-32 | O,O | $—(CH_2)_3N(Et)_3^+$ | $—(CH_2)_3N(Et)_3^+$ | Et | 5-Ph | 5-Ph | $3Br^-$ | |
| II-33 | O,O | $—(CH_2)_3N(Pr)_3^+$ | $—(CH_2)_3N(Pr)_3^+$ | Et | 5-Ph | 5-Ph | $3Br^-$ | |
| II-34 | O,O | $(CH_2)_3N(Me)_3^+$ | $—(CH_2)_3N(Me)_3^+$ | Et | 5-Cl | 5-Cl | $3Br^-$ | |
| II-35 | O,O | $—(CH_2)_3N(Me)_3^+$ | $—(CH_2)_3N(Me)_3^+$ | Me | 5-Ph | 5-Ph | $3Br^-$ | |
| II-36 | O,O | $—(CH_2)_3N(Me)_3^+$ | $—(CH_2)_3N(Me)_3^+$ | H | 5-Ph | 5-Ph | $3Br^-$ | +3 |
| II-37 | O,O | 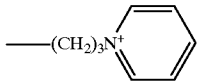 | 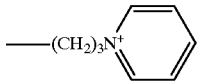 | Et | 5-Ph | 5-Ph | $3Br^-$ | +3 |
| II-38 | O,O | 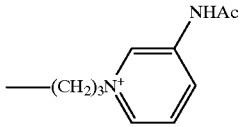 | 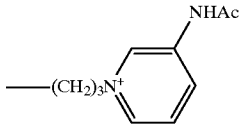 | Et | 5-Ph | 5-Ph | $3Br^-$ | +3 |

TABLE IA-continued

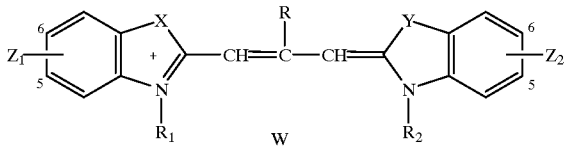

| Dye | X,Y | $R_1$ | $R_2$ | R | $Z_1$ | $Z_2$ | W | Net Charge |
|---|---|---|---|---|---|---|---|---|
| II-39 | O,O | 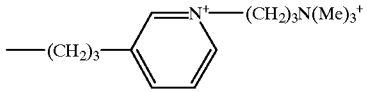 | 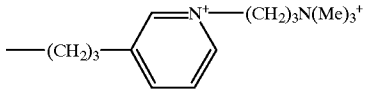 | Et | 5-Ph | 5-Ph | $5Br^-$ | +5 |
| II-40 | O,O | $—(CH_2)_3P(Me)_3^+$ | $—(CH_2)_3P(Me)_3^+$ | Et | 5-Ph | 5-Ph | $3PTS^-$ | +3 |
| II-41 | O,S | $—(CH_2)_3N(Me)_3^+$ | $—(CH_2)_3N(Me)_3^+$ | Et | 5-Ph | 5-Cl | $3PTS^-$ | +3 |
| II-42 | O,S | $—(CH_2)_3N(Me)_3^+$ | Et | Et | 5-Ph | 5-Cl | $2PTS^-$ | +2 |
| II-43 | NEt,NEt | $—(CH_2)_3N(Me)_3^+$ | $—(CH_2)_3N(Me)_3^+$ | H | 5-Cl,6-Cl | 5-C,6-Cll | $3PTS^-$ | +3 |
| II-44 | NMe,NMe | $—(CH_2)_3N(Me)_3^+$ | $—(CH_2)_3N(Me)_3^+$ | H | $5-CF_3$ | $5-CF_3$ | $3Br^-$ | +3 |
| II-45 | S,S | $—(CH_2)_3N(Me)_3^+$ | -Et | Et | Ph | Cl | $2Br^-$ | +2 |
| II-46 | S,S | $—(CH_2)_3N(Me)_3^+$ | $—(CH_2)_3N(Me)_3^+$ | Et | Cl | Cl | $3Br^-$ | +3 |
| II-47 | S,S | $—(CH_2)_3N(Me)_3^+$ | $—(CH_2)_3N(Me)_3^+$ | Et | Ph | Ph | $3Br^-$ | +3 |
| II-48 | S,S | $—(CH_2)_3N(Me)_3^+$ | $—(CH_2)_3N(Me)_3^+$ | Ph | Ph | Ph | $3Br^-$ | +3 |
| II-49 | S,S | $—(CH_2)_3P(Me)_3^+$ | $—(CH_2)_3P(Me)_3^+$ | Et | Ph | Ph | $3PTS^-$ | +3 |

Ph is phenyl, Me is methyl, Et is ethyl, $TEAH^+$ is Triethylammonium, PTS is p-toluenesulfonate.

II-50
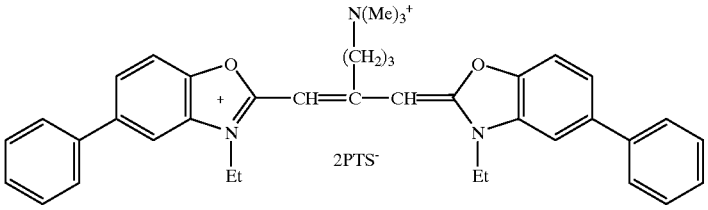
II-51
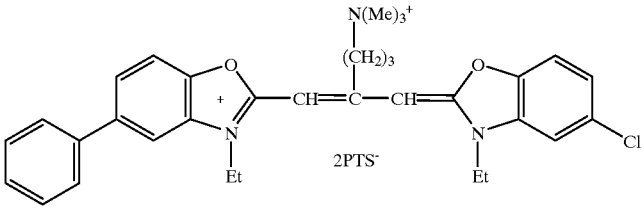
II-52
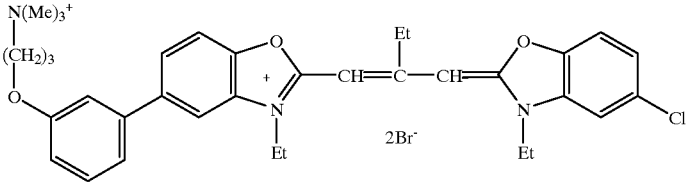
II-53
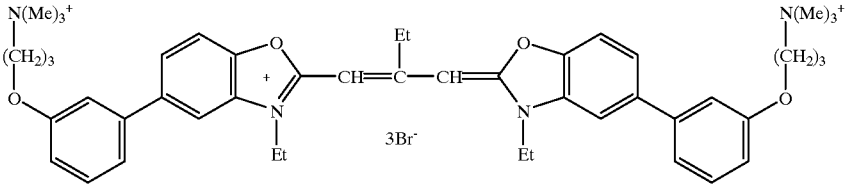
II-54
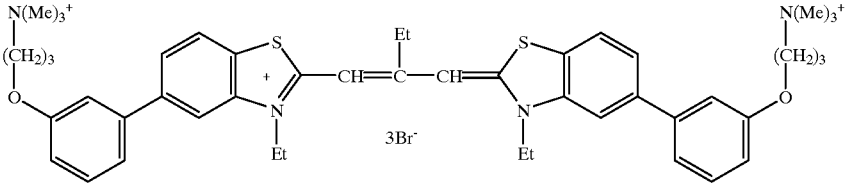
II-55
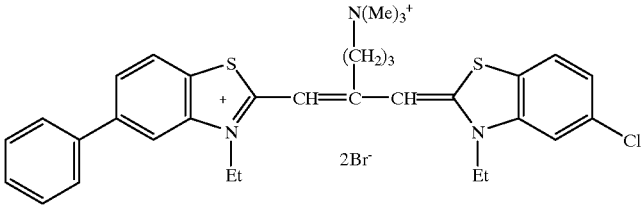

In a preferred embodiment of the invention, one of the dye layers comprises a dye of formula A and the other dye layer comprises a dye of formula B:

(A)

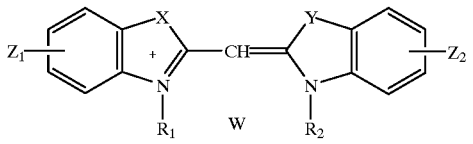

(B)

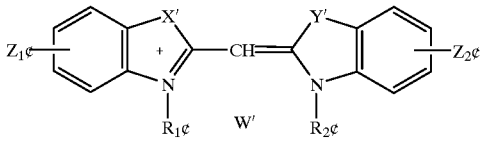

wherein

X, Y, represent independently O, S, $NR_3$, Se, —CH═CH—;

X', Y', represent independently O, S, $NR_4$, Se, —CH═CH—, or $C(R_5)R_6$;

$R_3$, $R_4$, $R_5$, $R_6$ independently represent substituted or unsubstituted alkyl or substituted or unsubstituted aryl;

$R_1$ and $R_2$ are substituted or unsubstituted alkyl or substituted or unsubstituted aryl and at least one of $R_1$ or $R_2$ has an anionic substituent;

$R_1'$ and $R_2'$ are substituted or unsubstituted alkyl or aryl and at least one of $R_1'$ and $R_2'$ has a cationic substituent;

$Z_1$, $Z_2$, $Z_1'$, $Z_2'$ each independently represents hydrogen or one or more substituents which, optionally, may form fused aromatic rings;

W represents one or more cationic counterions if necessary; and

W' represents one or more anionic counterions.

Dyes useful in the practice of this invention can be prepared according to techniques that are well-known in the art, such as described in Hamer, *Cyanine Dyes and Related Compounds,* 1964 (publisher John Wiley & Sons, New York, N.Y.) and *The Theory of the Photographic Process,* $4^{th}$ edition, T. H. James, editor, Macmillan Publishing Co., New York, 1977. The amount of sensitizing dye that is useful in the invention may be from 0.001 to 4 millimoles, but is preferably in the range of 0.01 to 4.0 millimoles per mole of silver halide and more preferably from 0.10 to 4.0 millimoles per mole of silver halide. Optimum dye concentrations can be determined by methods known in the art.

The dyes may be added to an emulsion of the silver halide grains and a hydrophilic colloid at any time prior to, during, or after chemical sensitization. Preferably the dye or dyes of the inner layer are added at a level such that, along with any other adsorbants (e.g., antifogants), they will substantially cover at least 80% and more preferably 90% of the surface of the silver halide grain. The area a dye covers on the silver halide surface can be determined by preparing a dye concentration series and choosing the dye level for optimum performance or by well-known techniques such as dye adsorption isotherms (for example see W. West, B. H. Carroll, and D. H. Whitcomb, J. Phys. Chem, 56, 1054 (1962)).

In many cases it is preferable to add at least one dye, preferably an anionic dye, before the chemical sensitization. The dye forming the second layer, preferably the cationic dye, is added preferably either during or after the chemical sensitization. The level of the dye forming the second layer is such that it is preferably between 20%–300% of monolayer coverage and more preferably between 50%–150% of monolayer coverage. In some cases it is then desirable to have addition of at least a third dye (preferably an anionic dye). In some cases this can stabilize the dye layers. The third dye can be added before, during or after the chemical sensitization. Preferably it is added after the chemical sensitization and after the second dye addition. The third dye is preferably between 20%–300% of monolayer coverage and more preferably between 50%–150% of monolayer coverage.

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1996, Number 389, Item 38957, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex,. 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Patent No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds which may be useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydipersed or monodispersed. Tabular grain silver halide emulsions may also be used.

The silver halide grains to be used in the invention may be prepared according to methods known in the art, such as those described in *Research Disclosure I* and *The Theory of the Photographic Process,* $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure*, Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexaco-ordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I,* Section IV (pages 510–511) and the references cited therein.

The silver halide may be sensitized by sensitizing dyes by any method known in the art, such as described in *Research Disclosure I.* The dyes may, for example, be added as a solution or dispersion in water, alcohol, aqueous gelatin, alcoholic aqueous gelatin, etc.. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I,* section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in *The Theory of the*

*Photographic Process,* 4th edition, T. H. James, editor, Macmillan Publishing Co., New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(α-(methanesulfonamido) ethylaniline sesquisulfate hydrate, 4-amino-3-methyl-N-ethyl-N-(α-hydroxyethyl)aniline sulfate, 4-amino-3-α-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition 5 metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

Example of Dye Synthesis (3-Bromopropyl)trimethylammonium bromide was obtained from Aldrich Chemical Company. The bromide salt was converted to the hexafluorophosphate salt to improve the compounds solubility in valeronitrile. Reaction of a heterocyclic base with 3-(bromopropyl)trimethylammonium hexafluorophosphate in valeronitrile gave the corresponding quaternary salt. For example, reaction of 2-methyl-5-phenylbenzothiazole with 3-(bromopropyl) trimethylammonium hexafluorophosphate gave 2-methyl-5-phenyl-3-(3 -(trimethylammonio)propyl)benzothiazolium bromide hexafluorophosphate. Dyes were prepared from quaternary salt intermediates by standard methods such as described in F. M. Hamer, *Cyanine Dyes and Related Compounds,* 1964 (publisher John Wiley & Sons, New York, N.Y.) and *The Theory of the Photographic Process,* 4th edition, T. H. James, editor, Macmillan Publishing Co., New York, 1977. For example reaction of 5-chloro-2-methyl-3-(3-(trimethylammonio)propyl)benzothiazolium bromide hexafluorophosphate with acetic anhydride, isoamyl nitrite, and triethylamine followed by treatment with tetrabutylammonium bromide gave 5,5'-dichloro-3,3'-di(3-(trimethylammonio)propyl)thiacyanine tribromide. Reaction of 5-chloro-2-methyl-3-(3-(trimethylammonio)propyl) benzothiazolium bromide hexafluorophosphate with anhydro-5-chloro-2-((hydroxyimino)methyl)-3-(3-sulfopropyl)benzothiazolium hydroxide, acetic anhydride, and triethylamine gave anhydro-5,5'-dichloro-3-(3-(trimethylammonio)propyl)-3'-(3-sulfopropyl)thiacyanine bromide hydroxide. Guanidinium substituted dyes can be prepared by reaction of the corresponding amino substituted dyes with 1-H-pyrazole-1-carboxamidine hydrochloride (S. Bernatowicz, Y. Wu, and G. R. Matsueda, J. Org. Chem. 2497 (1992)).

Example of Phase Behavior & Spectral Absorption Properties of Dyes Dispersed in Aqueous Gelatin Dye dispersions (5.0 gram total weight) were prepared by combining known weights of water, deionized gelatin and solid dye into screw-capped glass vials which were then thoroughly mixed with agitation at 60° C.–80° C. for 1–2 hours in a Lauda model MA 6 digital water bath. Once homogenized, the dispersions were cooled to room temperature. Following thermal equilibration, a small aliquot of the liquid dispersion was transferred to a thin-walled glass capillary cell (0.0066 cm pathlength) using a pasteur pipette. The thin-film dye dispersion was then viewed in polarized light at 16× objective magnification using a Zeiss Universal M microscope fitted with polarizing elements. Dyes forming a liquid-crystalline phase (i.e. a mesophase) in aqueous gelatin were readily identified microscopically from their characteristic birefringent type-textures, interference colours and shear-flow characteristics. (In some instances, polarized-light optical microscopy observations on thicker films of the dye dispersion, contained inside stoppered 1 mm pathlength glass cells, facilitated the identification of the dye liquid-crystalline phase). For example, dyes forming a lyotropic nematic mesophase typically display characteristic fluid, viscoelastic, birefringent textures including so-called Schlieren, Tiger-Skin, Reticulated, Homogeneous (Planar), Thread-Like, Droplet and Homeotropic (Pseudoisotropic). Dyes forming a lyotropic hexagonal mesophase typically display viscous, birefringent Herringone, Ribbon or Fan-Like textures. Dyes forming a lyotropic smectic mesophase typically display so-called Grainy-Mosaic, Spherulitic, Frond-Like (Pseudo-Schlieren) and Oily-Streak birefringent textures. Dyes forming an isotropic solution phase (non-liquid-crystalline) appeared black (i.e. non-birefringent) when viewed microscopically in polarized light. The same thin-film preparations were then used to determine the spectral absorption properties of the aqueous gelatin-dispersed dye using a Hewlett Packard 8453 UV-visible spectrophotometer. Representative data are shown in Table A.

TABLE A

| Dye | Dye Conc. (% w/w) | Gelatin Conc. (% w/w) | Physical State of Dispersed Dye | Dye Aggregate Type |
|---|---|---|---|---|
| I-2 | 0.03 | 3.5 | smectic liquid crystal | J-aggregate |
| I-1 | 0.06 | 3.5 | smectic liquid crystal | J-aggregate |
| II-2 | 0.05 | 3.5 | isotropic solution | H-aggregate |
| II-4 | 0.04 | 3.5 | smectic liquid crystal | J-aggregate |
| II-3 | 0.06 | 3.5 | smectic liquid crystal | J-aggregate |

TABLE A-continued

| Dye | Dye Conc. (% w/w) | Gelatin Conc. (% w/w) | Physical State of Dispersed Dye | Dye Aggregate Type |
|---|---|---|---|---|
| II-8 | 0.05 | 3.5 | isotropic solution | H-aggregate |
| II-10 | 0.20 | 3.5 | isotropic solution | H-aggregate |
| II-11 | 0.06 | 3.5 | isotropic solution | H-aggregate |
| II-14 | 0.06 | 3.5 | isotropic solution | H-aggregate |
| II-15 | 0.06 | 3.5 | isotropic solution | H-aggregate |
| I-9 | 0.05 | 3.5 | smectic liquid crystal | J-aggregate |
| I-10 | 0.05 | 3.5 | smectic liquid crystal | J-aggregate |
| II-30 | 0.06 | 3.5 | smectic liquid crystal | J-aggregate |
| II-38 | 0.13 | 3.5 | smectic liquid crystal | J-aggregate |
| II-28 | 0.06 | 3.5 | smectic liquid crystal | J-aggregate |
| II-29 | 0.30 | 3.5 | isotropic solution | H-aggregate |
| II-36 | 0.12 | 3.5 | isotropic solution | H-aggregate |
| II-35 | 0.20 | 3.5 | smectic liquid crystal | J-aggregate |
| II-31 | 0.20 | 3.5 | smectic liquid crystal | J-aggregate |
| I-12 | 0.05 | 3.5 | smectic liquid crystal | J-aggregate |
| II-45 | 0.06 | 3.5 | isotropic solution | H-aggregate |
| II-47 | 0.20 | 3.5 | nematic liquid crystal | J-aggregate |
| II-1 | 0.03 | 3.5 | isotropic solution | H-aggregate |
| II-13 | 0.13 | 3.5 | isotropic solution | H-aggregate |
| II-46 | 0.06 | 3.5 | isotropic solution | H-aggregate |
| II-37 | 0.20 | 3.5 | smectic liquid crystal | J-aggregate |
| II-39 | 0.12 | 3.5 | isotropic solution | H-aggregate |
| II-15 | 0.06 | 3.5 | isotropic solution | H-aggregate |
| II-16 | 0.10 | 3.5 | isotropic solution | H-aggregate |
| I-11 | 0.10 | 3.5 | smectic liquid crystal | J-aggregate |
| II-32 | 0.30 | 3.5 | smectic liquid crystal | J-aggregate |
| II-33 | 0.25 | 3.5 | smectic liquid crystal | J-aggregate |

The data clearly demonstrate that the thermodynamically stable form of many inventive dyes when dispersed in aqueous gelatin as described above (in the absence of silver halide grains) is liquid crystalline. Furthermore, the liquid-crystalline form of these inventive dyes is J-aggregated and exhibits a characteristically sharp, intense and bathochromically shifted J-band spectral absorption peak, generally yielding strong fluorescence. In some instances the inventive dyes possessing low gelatin solubility preferentially formed a H-aggregated dye solution when dispersed in aqueous gelatin, yielding a hysochromically-shifted H-band spectral absorption peak. Ionic dyes exhibiting the aforementioned aggregation properties were found to be particularly useful as antenna dyes for improved spectral sensitization when used in combination with an underlying silver halide-adsorbed dye of opposite charge.

PHOTOGRAPHIC EVALUATION

EXAMPLE 1

Film coating evaluations were carried out in black and white format on a sulfur-and-gold sensitized 0.78 $\mu$m silver chloride cubic emulsion containing bromide (1 mol %) added as a Lippmann silver bromide emulsion. The antifoggant was (1-(3-acetamidophenyl)-5-mercaptotetrazole). The first sensitizing dye (dye level 0.4 mmol/Ag mole, which is estimated to be approximately monolayer coverage) was added before the chemical sensitization. The second dye (dye level was 0.4 mmol/Ag mole or 0.6 mmole/Ag mole, see Table II), when present, was added to the melts after the chemical sensitization cycle, but prior to dilution of the melts.

Single-layer coatings were made on acetate support. Silver laydown was 1.6 g/m$^2$ (150 mg/ft$^2$). Gelatin laydown was 1.3 g/m$^2$ (125 mg/ft$^2$). A hardened overcoat was at 1.6 g/m$^2$ (150 mg/ft$^2$) gelatin.

Sensitometric exposures (0.1 sec) were done using a 365 nm Hg-line exposure or a tungsten exposure with filtration to stimulate a daylight exposure. Processing conditions are shown below. Speed was measured at a density of 0.15 above minimum density. Results are shown in Table II.

Figure 2:
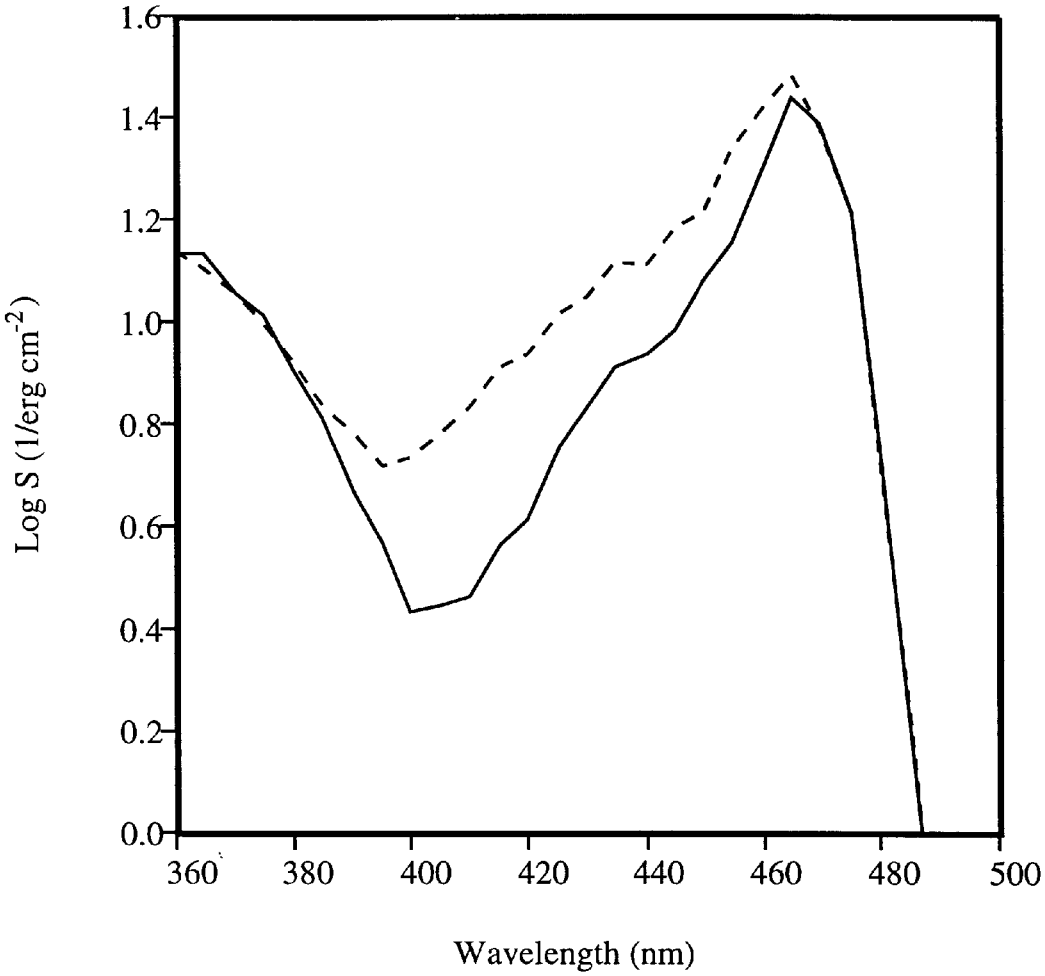
Figure 3:
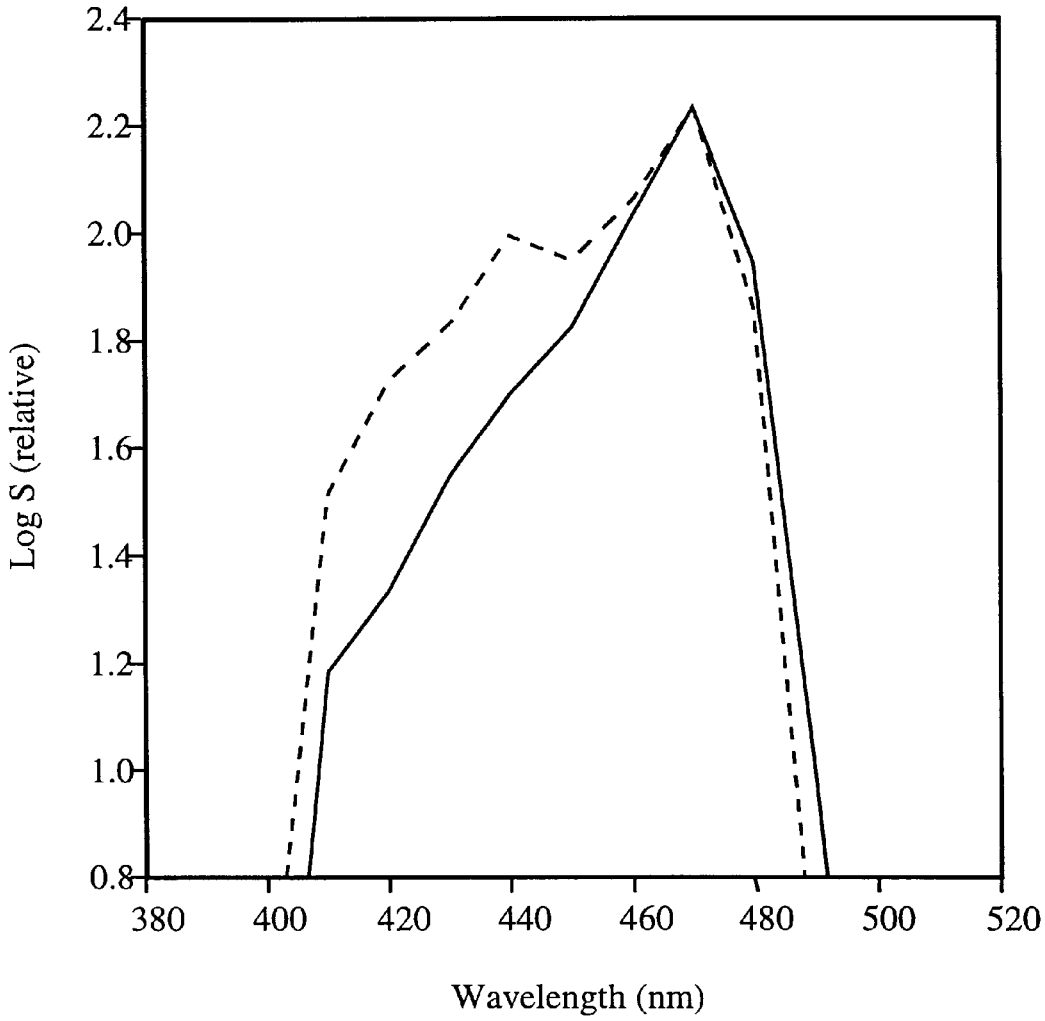

To determine the spectral photographic sensitivity distribution, the coatings were given 0.1 sec exposure on a wedge spectrographic instrument covering a wavelength range from 350 to 750 nm. The instrument contains a tungsten light source and a step tablet ranging in density from 0 to 3 density units in 0.3 density steps. Correction for the instrument's variation in spectral irradiance with wavelength was done via computer. After processing, a plot of log relative spectral sensitivity vs. wavelength can be obtained. Spectral sensitivity curves for several examples of the invention are shown in FIGS. 1–3.

Temperature: 68° F.

| Processing Chemical | Process Time |
|---|---|
| DK-50 developer | 6'00" |
| Stop Bath* | 15" |
| Fix** | 5'00" |
| Wash | 10'00" |

*composition is 128 mL acetic acid diluted to 8 L with distilled water.
**composition is 15.0 g sodium sulfite, 240.0 g sodium thiosulfate, 13.3 mL glacial acetic acid, 7.5 g boric acid, and 15.0 g potassium aluminum sulfate diluted to 1.0 L with distilled water.

TABLE II

Sensitometric Speed Evaluation of Layered Dyes in Example 1.

| Example | First Dye | First Dye Level[a] | Second Dye | Second Dye Level[a] | 365L[b] | DL[c] | (DL-365L)[d] | Normalized Relative Sensitivity[e] | Normalized Relative Absorption | Layering Efficiency | Remarks |
|---|---|---|---|---|---|---|---|---|---|---|---|
| 1-1 | I-1 | 0.4 | — | — | 235 | 224 | −11 | 100 | 100 | 0 | Comparison |
| 1-2 | I-1 | 0.4 | I-1 | 0.4 | 233 | 222 | −11 | 100 | 105 | 0 | Comparison |
| 1-3 | I-1 | 0.4 | II-8 | 0.4 | 228 | 228 | 0 | 129 | 144 | 66 | Invention |
| 1-4 | I-1 | 0.4 | II-10 | 0.4 | 231 | 229 | −02 | 123 | 120 | 115 | Invention |
| 1-5 | I-1 | 0.4 | I-1 | 0.6 | 235 | 220 | −15 | 89 | 100 | 0 | Comparison |

TABLE II-continued

Sensitometric Speed Evaluation of Layered Dyes in Example 1.

| Example | First Dye | First Dye Level[a] | Second Dye | Second Dye Level[a] | 365L[b] | DL[c] | (DL-365L)[d] | Normalized Relative Sensitivity[e] | Normalized Relative Absorption | Layering Efficiency | Remarks |
|---|---|---|---|---|---|---|---|---|---|---|---|
| 1-6 | I-1 | 0.4 | II-8 | 0.6 | 225 | 228 | +03 | 138 | 155 | 69 | Invention |
| 1-7 | I-1 | 0.4 | II-10 | 0.6 | 231 | 233 | +02 | 135 | 144 | 80 | Invention |

[a]mmol/Ag mol.
[b]speed (reported in 100 × logE units) from a 365 line exposure.
[c]speed from an exposure that simulates daylight.
[d]the daylight speed of the sample minus the 365 line speed of the sample - this corrects for minor differences in the chemical sensitization and development characteristics and gives a better measure of dye performance.
[e]based on the daylight speed of the sample minus the 365 line speed of the sample and normalized relative to the comparison dye.

PHOTOGRAPHIC EVALUATION

EXAMPLE 2

Film coating evaluations were carried out in black and white format on a sulfur-and-gold sensitized 0.2 μm silver bromide cubic emulsion containing iodide (2.5 mol %). The first sensitizing dye (dye level 1.4 mmol/Ag mole which is estimated to be near monolayer coverage) was added and then the melt was heated to 60 ° C. for 15' at which time it was cooled to 40° C. The second dye (dye level was 1.4 mmol/Ag mole), when present, was added to the melts after the finish cycle, but prior to dilution of the melts. Single-layer coatings were made on acetate support. Silver laydown was 0.8 g/m$^2$. Gelatin laydown was 4.8 g/m$^2$ (450 mg/ft$^2$). A hardened overcoat was at 1.6 g/m$^2$ (150 mg/ft$^2$) gelatin.

Sensitometric exposures (1.0 sec) were done using 365 nm Hg-line exposure or tungsten exposure with filtration to stimulate a daylight exposure. The elements were processed in Kodak RP X-OMAT™ chemistry. Speed was measured at a density of 0.15 above minimum density. The results are reported in Table III.

found in Fenton, et al., U.S. Pat. No. 5,476,760. Briefly, 3.6% KI was run after precipitation of 70% of the total silver, followed by a silver over-run to complete the precipitation. The emulsion contained 50 molar ppm of tetrapotassium hexacyanoruthenate ($K_4Ru(CN)_6$) added between 66 and 67% of the silver precipitation. The emulsion (0.0143 mole Ag) was heated to 40° C. and sodium thiocyanate (120 mg/Ag mole) was added and after a 20' hold the first sensitizing dye (see Table IV for dye and level) was added. After an additional 20' a sulfur agent (N-(carboxymethyl-trimethyl-2-thiourea, sodium salt, 2.4 mg/Ag mole), a gold salt (bis(1,3,5-trimethyl-1,2,4-triazolium-3-thiolate) gold(I) tetrafluoroborate, 2.0 mg/Ag mole), and an antifoggant (3-(3-((methylsulfonyl)amino)-3-oxopropyl)-benzothiazolium tetrafluoroborate), 45 mg/Ag mole) were added at 5' intervals, the melt was held for 20' and then heated to 60° C. for 20'. After cooling to 40° C. the second dye (see Table IV for dye and level), when present, was added to the melt. After 30' at 40° C., gelatin (647 g/Ag mole total), distilled water (sufficient to bring the final concentration to 0.11 Ag mmole/g of melt) and tetrazaindine (1.0 g/Ag mole) were added. Single-layer coatings were made on acetate support. Silver laydown was 0.5 g/m$^2$ (50 mg/ft$^2$). Gelatin laydown was 3.2 g/m$^2$ (300 mg/ft$^2$). A hardened overcoat was at 1.6 g/m$^2$ (150 mg/ft$^2$) gelatin.

TABLE III

Sensitometric Speed Evaluation of Layered Dyes in Example 2.

| Example | First Dye | First Dye Level[a] | Second Dye | Second Dye Level[a] | 365L[b] | DL[c] | (DL-365L)[d] | Normalized Relative Sensitivity[e] | Normalized Relative Absorption | Layering Efficiency | Remarks |
|---|---|---|---|---|---|---|---|---|---|---|---|
| 2-1 | I-9 | 1.40 | — | — | 231 | 240 | 09 | 100 | 100 | 0 | Comparison |
| 2-2 | I-9 | 1.40 | II-35 | 1.40 | 251 | 266 | 15 | 115 | 138 | 39 | Invention |
| 2-3 | I-9 | 1.40 | II-36 | 1.40 | 264 | 281 | 17 | 120 | 138 | 53 | Invention |

[a]mmol/Ag mol.
[b]speed (reported in 100 × logE units) from a 365 line exposure.
[c]speed from an exposure that simulates daylight.
[d]the daylight speed of the sample minus the 365 line speed of the sample - this corrects for minor differences in the chemical sensitization and development characteristics and gives a better measure of dye performance.
[e]based on the daylight speed of the sample minus the 365 line speed of the sample and normalized relative to the comparison dye.

PHOTOGRAPHIC EVALUATION

EXAMPLE 3

Film coating evaluations were carried out in black and white format on a sulfur-and-gold sensitized 3.9 μm×0.11 μm silver bromide tabular emulsion containing iodide (3.6 mol %). Details of the precipitation of this emulsion can be Sensitometric exposures (0.01 sec) were done using 365 nm Hg-line exposure or tungsten exposure with filtration to stimulate a daylight exposure. Processing was carried out as described for Photographic Example 2. Results are shown in the Table IV.

TABLE IV

Sensitometric Speed Evaluation of Layered Dyes in Example 3.

| Example | First Dye | First Dye Level[a] | Second Dye | Second Dye Level[a] | 365L[b] | DL[c] | (DL-365L)[d] | Normalized Relative Sensitivity[e] | Normalized Relative Absorption | Layering Efficiency | Remarks |
|---|---|---|---|---|---|---|---|---|---|---|---|
| 3-1 | I-10 | 0.96 | — | — | 186 | 201 | 15 | 100 | 100 | 0 | Comparison |
| 3-2 | I-10 | 0.96 | II-29 | 0.96 | 184 | 206 | 22 | 117 | 151 | 33 | Invention |
| 3-3 | I-12 | 0.90 | — | — | 282 | 298 | 16 | 100 | 100 | 0 | Comparison |
| 3-4 | I-12 | 0.90 | II-47 | 1.13 | 231 | 250 | 19 | 107 | 115 | 47 | Invention |

[a]mmol/Ag mol.
[b]speed (reported in 100 × logE units) from a 365 line exposure.
[c]speed from an exposure that simulates daylight.
[d]the daylight speed of the sample minus the 365 line speed of the sample - this corrects for minor differences in the chemical sensitization and development characteristics and gives a better measure of dye performance.
[e]based on the daylight speed of the sample minus the 365 line speed of the sample and normalized relative to the comparison dye.

PHOTOGRAPHIC EVALUATION

EXAMPLE 4

Film coating evaluations were carried out in black and white format on a sulfur-and-gold sensitized 3.9 μm×0.11 μm silver bromide tabular emulsion containing 3.6 mol % iodide (see Example 3). The emulsion (0.0143 mole Ag) was heated to 40° C. and sodium thiocyanate (120 mg/Ag mole) was added and after a 20' hold the first sensitizing dye (see Table V for dye and level) was added. After an additional 20' a gold salt (bis(1,3,5-trimethyl-1,2,4-triazolium-3-thiolate) gold(I) tetrafluoroborate, 2.0 mg/Ag mole), sulfur agent (N-(carboxymethyl-trimethyl-2-thiourea, sodium salt, 2.4 mg/Ag mole) and an antifoggant (3-(3-((methylsulfonyl) amino)-3-oxopropyl)-benzothiazolium tetrafluoroborate), 45 mg/Ag mole) were added at 5' intervals, the melt was held for 20' and then heated to 60° C. for 20'. After cooling to 40° C. the second dye (see Table V for dye and level), when present was added to the melt. After 30' at 40° C., gelatin (647 g/Ag mole total), distilled water (sufficient to bring the final concentration to 0.11 Ag mmole/g of melt) and tetrazaindine (1.0 g/Ag mole) were added. Coating, exposure and processing, were carried out as described for Photographic Example 3. Results are shown in the Table V.

PHOTOGRAPHIC EVALUATION

EXAMPLE 5

Film coating evaluations were carried out in black and white format on a sulfur-and-gold sensitized 3.9 μm×0.11 μm silver bromide tabular emulsion containing 3.6 mol % iodide (see Example 3). The emulsion (0.0143 mole Ag) was heated to 40° C. and sodium thiocyanate (100 mg/Ag mole) was added and after a 20' hold the first sensitizing dye (see Table VI for dye and level) was added. After an additional 20' a gold salt (bis(1,3,5-trimethyl-1,2,4-triazolium-3-thiolate) gold(I) tetrafluoroborate, 2.4 mg/Ag mole), sulfur agent (N-(carboxymethyl-trimethyl-2-thiourea, sodium salt, 2.3 mg/Ag mole) and an antifoggant (3-(3-((methylsulfonyl) amino)-3-oxopropyl)-benzothiazolium tetrafluoroborate), 37 mg/Ag mole) were added at 5' intervals, the melt was held for 20' and then heated to 60° C. for 20'. After cooling to 40° C. the second dye (see Table VI for dye and level), when present, was added to the melt. After 30' at 40° C., gelatin (324 g/Ag mole total), distilled water (sufficient to bring the final concentration to 0.11 Ag mmole/g of melt) and tetrazaindine (1.0 g/Ag mole) were added. Single-layer coatings were made on acetate support. Silver laydown was 1.1 g/m$^2$ (100 mg/ft$^2$). Gelatin laydown was 3.2 g/m$^2$ (300 mg/ft$^2$). A hardened overcoat was at 1.6 g/m$^2$ (150 mg/ft$^2$) gelatin.

Exposure and processing was carried out as described for Photographic Example 3. Results are shown in the Table VI.

TABLE V

Sensitometric Speed Evaluation of Layered Dyes in Example 4.

| Example | First Dye | First Dye Level[a] | Second Dye | Second Dye Level[a] | 365L[b] | DL[c] | (DL-365L)[d] | Normalized Relative Sensitivity[e] | Normalized Relative Absorption | Layering Efficiency | Remarks |
|---|---|---|---|---|---|---|---|---|---|---|---|
| 4-1 | I-10 | 0.96 | — | — | 243 | 246 | 03 | 100 | 100 | 0 | Comparison |
| 4-2 | I-10 | 0.96 | II-31 | 0.96 | 234 | 249 | 15 | 132 | 135 | 91 | Invention |

[a]mmol/Ag mol.
[b]speed (reported in 100 × logE units) from a 365 line exposure.
[c]speed from an exposure that simulates daylight.
[d]the daylight speed of the sample minus the 365 line speed of the sample - this corrects for minor differences in the chemical sensitization and development characteristics and gives a better measure of dye performance.
[e]based on the daylight speed of the sample minus the 365 line speed of the sample and normalized relative to the comparison dye.

TABLE VI

Sensitometric Speed Evaluation of Layered Dyes in Example 5.

| Example | First Dye | First Dye Level[a] | Second Dye | Second Dye Level[a] | 365L[b] | DL[c] | (DL-365L)[d] | Normalized Relative Sensitivity[e] | Normalized Relative Absorption | Layering Efficiency | Remarks |
|---|---|---|---|---|---|---|---|---|---|---|---|
| 5-1 | I-3 | 1.0 | — | — | 256 | 241 | −15 | 100 | 100 | 0 | Comparison |
| 5-2 | I-3 | 1.0 | II-11 | 1.0 | 243 | 237 | −06 | 123 | 148 | 48 | Invention |
| 5-3 | I-3 | 1.0 | II-14 | 1.0 | 255 | 244 | −11 | 110 | 135 | 29 | Invention |
| 5-4 | I-3 | 1.0 | II-15 | 1.0 | 253 | 245 | −08 | 117 | 135 | 49 | Invention |
| 5-5 | I-5 | 1.0 | — | — | 254 | 246 | −08 | 100 | 100 | 0 | Comparison |
| 5-6 | I-5 | 1.0 | II-14 | 1.0 | 249 | 249 | 0 | 120 | 148 | 42 | Invention |

[a]mmol/Ag mol.
[b]speed (reported in 100 × logE units) from a 365 line exposure.
[c]speed from an exposure that simulates daylight.
[d]the daylight speed of the sample minus the 365 line speed of the sample - this corrects for minor differences in the chemical sensitization and development characteristics and gives a better measure of dye performance.
[e]based on the daylight speed of the sample minus the 365 line speed of the sample and normalized relative to the comparison dye.

It can be seen from photographic examples 1–5 that the dye combinations of the invention give enhanced speed relative to the comparisons on various types of emulsions. It can also be seen from FIGS. 1–3, that the dye combinations of the invention can give a photographic sensitivity distribution that is confined to one color record, for example, the blue record, 400–500 nm. By contrast, elements described previously, e.g., U.S. Pat. No. 3,622,316 (see FIGS. 1, 5, 7 and 9 in U.S. Pat. No. 3,622,316) give a very broad undesirable sensitization envelope. Thus the dye combinations of the invention will give much better color reproduction.

The invention has been described in detail with particular reference to certain preferred embodiments thereof, but it will be understood that variations and modifications can be effected within the spirit and scope of the invention.

What is claimed is:

1. A silver halide photographic material comprising at least one silver halide emulsion comprising silver halide grains having associated therewith at least two dye layers comprising (a) an inner dye layer adjacent to the silver halide grain and comprising at least one dye that is capable of spectrally sensitizing silver halide and (b) an outer dye layer adjacent to the inner dye layer and comprising at least one dye, wherein the dye layers are held together by non-covalent forces or by in situ bond formation; the outer dye layer adsorbs light at equal or higher energy than the inner dye layer; and the energy emission wavelength of the outer dye layer overlaps with the energy absorption wavelength of the inner dye layer; and wherein the dye of the outer dye layer is a cyanine dye, merocyanine dye, arylidene dye, complex cyanine dye, complex merocyanine dye, homopolar cyanine dye, hemicyanine dye, styryl dye, hemioxonol dye, oxonol, dye anthraquinone dye, triphenylmethane dye, azo dye, azomethines, or coumarin dye.

2. A silver halide photographic material according to claim 1, wherein the inner dye layer comprises at least two dyes.

3. A silver halide photographic material according to claim 1, wherein the outer dye layer comprises at least two dyes.

4. A silver halide photographic material according to claim 1, wherein the following relationship is met:

$$E=100\Delta S/\Delta N_a \geqq 10$$

and $$\Delta N_a \geqq 10$$

wherein

E is the layering efficiency;

ΔS is the difference between the Normalized Relative Sensitivity (S) of an emulsion sensitized with the inner dye layer and the Normalized Relative Absorption of an emulsion sensitized with both the inner dye layer and the outer dye layer; and $\Delta N_a$ is the difference between the Normalized Relative Absorption ($N_a$) of an emulsion sensitized with the inner dye layer and the Normalized Relative Absorption of an emulsion sensitized with both the inner dye layer and the outer dye layer.

5. A silver halide photographic material according to claim 1, wherein dye or dyes of the outer dye layer and the dye or dyes of the inner dye layer have their maximum light absorption either between 400 to 500 nm or between 500 to 600 nm or between 600 and 700 nm or between 700 and 1000 nm.

6. A silver halide photographic material according to claim 1, wherein the dye or dyes of the outer dye layer aggregate in aqueous gelatin at a concentration of 1 weight percent or less.

7. A silver halide photographic material according to claim 1, wherein the dye or dyes of the outer dye layer form a liquid-crystalline phase in aqueous gelatin at a concentration of 1 weight percent or less.

8. A silver halide photographic material according to claim 1, wherein the dye or dyes of the outer dye layer and the dye or dyes of the inner dye layer form J-aggregates.

9. A silver halide photographic material according to claim 1, wherein the dye or dyes of the outer dye layer form an ionic bond with the dye or dyes of the inner dye layer when combined in aqueous gelatin.

10. A silver halide photographic material according to claim 1, wherein the dye or dyes of the outer dye layer form both ionic and hydrogen bonds with the dye or dyes of the inner dye layer when combined in aqueous gelatin.

11. A silver halide photographic material according to claim 1, wherein the dye or dyes of the outer dye layer form a covalent bond with the dye or dyes of the inner dye layer when combined in aqueous gelatin.

12. A silver halide photographic material according to claim 1, wherein the dye or dyes of the outer dye layer and dye or dyes of the inner dye layer form a metal complex when combined with a metal ion in aqueous gelatin.

13. A silver halide photographic material according to claim 1, wherein the dye or dyes of one of the layers has a net negative charge and the dye or dyes of the other layer has a net positive charge.

14. A silver halide photographic material according to claim 13, wherein the dye or dyes of the inner dye layer have a net negative charge and are present at a concentration of at least 80% of monolayer coverage and the dye or dyes of the outer dye layer have a net positive charge and are present in an amount of at least 50% or monolayer coverage.

15. A silver halide photographic material according to claim 13, wherein none of the dyes of the inner dye layer contains a nitrogen substituent substituted with an aromatic or heteroaromatic group and at least one of the dyes of the outer dye layer contains a nitrogen substituent substituted with an aromatic or heteroaromatic group.

16. A silver halide photographic material according to claim 13, wherein at least one dye of inner dye layer contains a nitrogen substituent substituted with an aromatic or heteroaromatic group and none of the dyes of the outer dye layer contains a nitrogen substituent substituted with an aromatic or heteroaromatic group.

17. A silver halide photographic material according to claim 1, wherein one of the layers comprises a blue-light-absorbing cyanine dye having a net charge of −1 and the other layer comprises a blue-light-absorbing cyanine dye having a net charge of +2 or +3.

18. A silver halide photographic material according to claim 1, wherein one of the layers comprises a green-light-absorbing cyanine dye having a net charge of −1 and the other layer comprises a green-light-absorbing cyanine dye having a net charge of +2 or +3.

19. A silver halide photographic material according to claim 1, wherein one of the layers comprises a red-light-absorbing cyanine dye having a net charge of −1 and the other layer comprises a red-light-absorbing cyanine dye having a net charge of +2 or +3.

20. A silver halide photographic material according to claim 1, wherein the inner dye layer comprises a dye of formula (Ia) or formula (Ib):

(Ia)

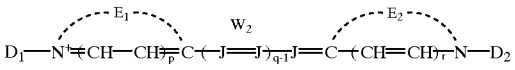

(Ib)

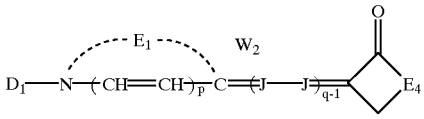

wherein:

$E_1$ and $E_2$ each independently represents the atoms necessary to form a substituted or unsubstituted heterocyclic ring which is a basic nucleus;

$E_4$ represents the atoms necessary to complete a substituted or unsubstituted heterocyclic acidic nucleus;

each J independently represents a substituted or unsubstituted methine group;

q is a positive integer of from 1 to 4;

p and r each independently represents 0 or 1;

$D_1$ and $D_2$ each independently represents substituted or unsubstituted alkyl or unsubstituted aryl and at least one of $D_1$ and $D_2$ contains an anionic substituent; and $W_2$ is one or more a counterions as necessary to balance the charge.

21. A silver halide photographic material according to claim 1 wherein the outer dye layer comprises a compound of formula (IIa), (IIb), or (IIc):

(IIa)

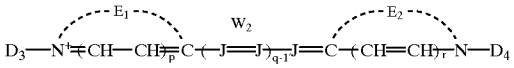

(IIb)

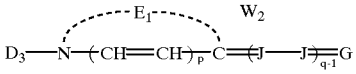

(IIc)

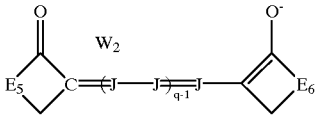

wherein:

$E_1$ and $E_2$ each independently represents the atoms necessary to form a substituted or unsubstituted heterocyclic ring which is a basic nucleus;

$E_5$ and $E_6$ each independently represents the atoms necessary to complete a substituted or unsubstituted acidic heterocyclic nucleus;

each J independently represents a substituted or unsubstituted methine group;

q is a positive integer of from 1 to 4, in formulae IIa and IIb and 2 to 4 in formula IIc;

p and r each independently represents 0 or 1;

$D_3$ and $D_4$ each independently represents substituted or unsubstituted alkyl or unsubstituted aryl;

G represents:

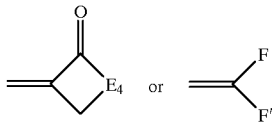

wherein $E_4$ represents the atoms necessary to complete a substituted or unsubstituted heterocyclic acidic nucleus and F and F' each independently represents a cyano radical, an ester radical, an acyl radical, a carbamoyl radical or an alkylsulfonyl radical, for each dye, at least one of $E_1$, $E_2$, $E_5$, $E_6$, J, G, $D_3$ or $D_4$ contains a cationic substituent; and $W_2$ is one or more a counterions as necessary to balance the charge.

22. A silver halide photographic material according to claim 1 or claim 19, wherein the outer dye layer comprises a compound of formula (IIa), (IIb), or (IIc):

(IIa)

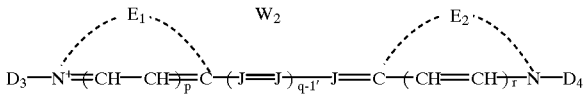

(IIb)

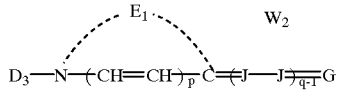

(IIc)

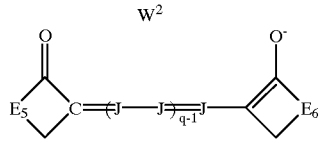

wherein:

$E_1$ and $E_2$ each independently represents the atoms necessary to form a substituted or unsubstituted heterocyclic ring which is a basic nucleus;

$E_5$ and $E_6$ each independently represents the atoms necessary to complete a substituted or unsubstituted acidic heterocyclic nucleus;

each J independently represents a substituted or unsubstituted methine group;

q is a positive integer of from 1 to 4, in formulae IIa and IIb and 2 to 4 in formula IIc;

p and r each independently represents 0 or 1;

$D_3$ and $D_4$ each independently represents substituted or unsubstituted alkyl or unsubstituted aryl;

G represents:

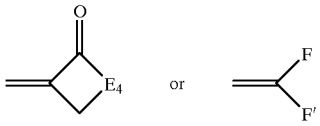

wherein $E_4$ represents the atoms necessary to complete a substituted or unsubstituted heterocyclic acidic nucleus and F and F' each independently represents a cyano radical, an ester radical, an acyl radical, a carbamoyl radical or an alkylsulfonyl radical, for each dye, at least one of $E_1$, $E_2$, $E_5$, $E_6$, J, G, $D_3$ or $D_4$ contains a cationic substituent; and $W_2$ is one or more a counterions as necessary to balance the charge.

23. A silver halide photographic material according to claim 21, wherein the inner layer comprises a dye of formula (Ia) and a dye of formula (IIb) and if either $D_1$ or $D_2$ contains an aromatic or hetero aromatic group, neither $D_3$ nor $D_4$ contains an aromatic or heteroaromatic group.

24. A photographic material according to claim 1, wherein one of the dye layers comprises a dye of formula (Ic) and the other dye layer comprises a dye of formula (IId):

Ic

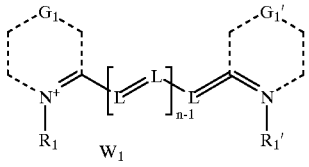

IId

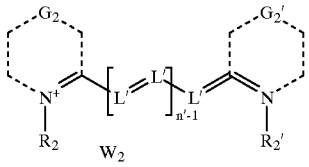

wherein:

$G_1$ and $G_1'$ each independently represents the atoms necessary to complete a benzothiazole nucleus, benzoxazole nucleus, benzoselenazole nucleus, benzotellurazole nucleus, quinoline nucleus, or benzimidazole nucleus in which $G_1$ and $G_1'$ independently may be substituted or unsubstituted;

$G_2$ and $G_2'$ each independently represents the atoms necessary to complete a benzothiazole nucleus, benzoxazole nucleus, benzoselenazole nucleus, benzotellurazole nucleus, quinoline nucleus, indole nucleus, or benzimidazole nucleus in which $G_2$, and $G_2'$ independently may be substituted or unsubstituted;

n and n' each independently represents a positive integer from 1 to 4, each L and L' independently represents a substituted or unsubstituted methine group;

$R_1$ and $R_1'$ each independently represents substituted or unsubstituted aryl or substituted or unsubstituted aliphatic group and at least one of $R_1$ and $R_1'$ has a negative charge;

$R_2$ and $R_2'$ each independently represents substituted or unsubstituted aryl or substituted or unsubstituted aliphatic group;

$W_1$ is a cationic counterion to balance the charge if necessary; and $W_2$ is one or more anionic counterions to balance the charge.

25. A silver halide photographic material according to claim 24, wherein at least one of $R_2$ and $R_2'$ has a positive charge; such that the net charge of the dye is +1, +2, +3, +4, or +5.

26. A silver halide photographic material according to claim 24, wherein if either $R_1$ or $R_1'$ contains an aromatic or heteroaromatic group neither $R_2$ nor $R_2'$ contains an aromatic or heteroaromatic group.

27. A silver halide photographic material according to claim 1, wherein one of the dye layers contains at least one dye of formula A and the other dye layer contains at least one dye form formula B:

(A)

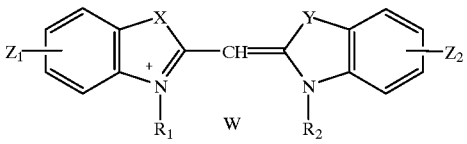

(B)

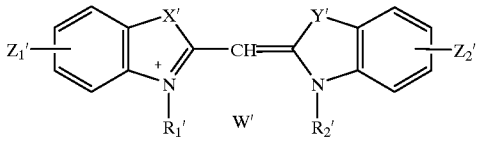

wherein

X, Y, represent independently O, S, $NR_3$, Se, —CH═CH—;

X', Y', represent independently O, S, $NR_4$, Se, —CH═CH—, or $C(R_5)R_6$;

$R_3$, $R_4$, $R_5$, $R_6$ independently represent substituted or unsubstituted alkyl or substituted or unsubstituted aryl;

$R_1$ and $R_2$ are substituted or unsubstituted alkyl or substituted or unsubstituted aryl and at least one of $R_1$ or $R_2$ has an anionic substituent;

$R_1'$ and $R_2'$ are substituted or unsubstituted alkyl or substituted or unsubstituted aryl and at least one of $R_1'$ and $R_2'$ has a cationic substituent;

$Z_1$, $Z_2$, $Z_1'$, $Z_2'$ each independently represents hydrogen or one or more substituents which, optionally, may form fused aromatic rings;

W represents one or more cationic counterions if necessary; and

W' represents one or more anionic counterions.

28. A silver halide photographic material comprising at least one silver halide emulsion comprising silver halide grains having associated therewith at least one dye having at least one anionic substituent and at least one dye having at least one cationic substituent.

29. A silver halide photographic material according to claim 28, wherein if the dye or dyes having an anionic substituent contain a nitrogen substituent substituted with an aromatic or heteroaromatic group then the dye or dyes having a cationic substituent do not contain a nitrogen substituent substituted with an aromatic or heteroaromatic group.

30. A silver halide photographic material according to claim 28, comprising a dye having at least two cationic substituents.

31. A silver halide photographic material according to claim 28, wherein at least one of said dyes forms a liquid-crystalline phase in aqueous gelatin at a concentration of 1 weight percent or less.

32. A silver halide photographic material according to claim 28, wherein at least one of said dyes is a cyanine dye.

33. A silver halide photographic material according to claim 28, wherein at least one of said dyes forms a J-aggregate.

34. A silver halide photographic material according to claim 28, wherein one of the dyes comprises a blue-light-absorbing cyanine dye having a net charge of −1 and the other of said dyes comprises a blue-light-absorbing cyanine dye having a net charge of +2 or +3.

35. A silver halide photographic material according to claim 28, wherein one of the dyes comprises a green-light-absorbing cyanine dye having a net charge of −1 and the other dyes comprises a green-light-absorbing cyanine dye having a net charge of +2 or +3.

36. A silver halide photographic material according to claim 28, wherein one of the dyes comprises a red-light-absorbing cyanine dye having a net charge of −1 and the other dye comprises a red-light-absorbing cyanine dye having a net charge of +2 or +3.

* * * * *

UNITED STATES PATENT AND TRADEMARK OFFICE

CERTIFICATE OF CORRECTION

PATENT NO. : 6,143,486
DATED : November 7, 2000
INVENTOR(S) : Richard L. Parton et al.

It is certified that error appears in the above-identified patent and that said Letters Patent is hereby corrected as shown below:

Column 40, claim 22, delete claim 22, lines 62-64 and Column 41, claim 22, lines 1-18.

Delete claim 22

"22. A silver halide photographic material according to Claim 1 or Claim 19, wherein the outer dye layer comprises a compound of formula (IIa), (IIb), or (IIc):

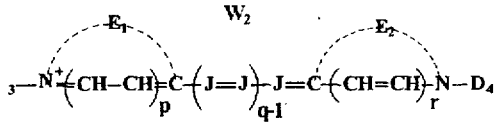

(IIa)

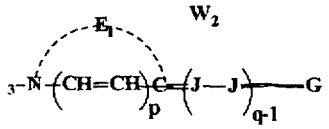

(IIb)

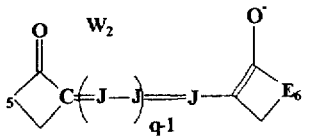

(IIc)

wherein:

$E_1$ and $E_2$ each independently represents the atoms necessary to form a substituted or unsubstituted heterocyclic ring which is a basic nucleus;

$E_5$ and $E_6$ each independently represents the atoms necessary to complete a substituted or unsubstituted acidic heterocyclic nucleus;

each J independently represents a substituted or unsubstituted methine group;

q is a positive integer of from 1 to 4, in formulae IIa IIb and 2 to 4 in formula IIc;

p and r each independently represents 0 or 1;

UNITED STATES PATENT AND TRADEMARK OFFICE

CERTIFICATE OF CORRECTION

PATENT NO. : 6,143,486
DATED : November 7, 2000
INVENTOR(S) : Richard L. Parton et al.

It is certified that error appears in the above-identified patent and that said Letters Patent is hereby corrected as shown below:

$D_3$ and $D_4$ each independently represents substituted or unsubstituted alkyl or unsubstituted aryl;

G represents:

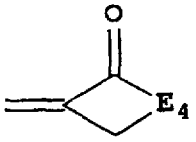

or

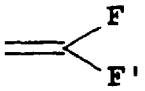

wherein $E_4$ represents the atoms necessary to complete a substituted or unsubstituted heterocyclic acidic nucleus and F and F' each independently represents a cyano radical, an ester radical, an acyl radical, a carbomoyl radical or an alkylsulfonyl radical, for each dye, at least one of $E_1$, $E_2$, $E_5$, $E_6$, J, G, $D_3$ or $D_4$ contains a cationic substituent; and $W_2$ is one or more a counterions as necessary to balance the charge."

Signed and Sealed this

Eighth Day of January, 2002

*Attest:*

*Attesting Officer*

JAMES E. ROGAN
*Director of the United States Patent and Trademark Office*